US006925350B2

(12) United States Patent
Watanabe

(10) Patent No.: US 6,925,350 B2
(45) Date of Patent: Aug. 2, 2005

(54) SYSTEM AND METHOD FOR INSPECTING CUSTOM-MADE CLOTHING

(76) Inventor: John S. Watanabe, 7-32-27 Sennan City Tatui, Osaka (JP)

( * ) Notice: Subject to any disclaimer, the term of this patent is extended or adjusted under 35 U.S.C. 154(b) by 0 days.

(21) Appl. No.: 10/764,209

(22) Filed: Jan. 22, 2004

(65) Prior Publication Data

US 2004/0153195 A1 Aug. 5, 2004

Related U.S. Application Data

(63) Continuation-in-part of application No. 10/342,671, filed on Jan. 14, 2003.

(51) Int. Cl.[7] ..... G06F 19/00
(52) U.S. Cl. ..... 700/132; 33/12
(58) Field of Search ..... 33/12; 700/131, 700/132, 134; 112/475.09

(56) References Cited

U.S. PATENT DOCUMENTS 5,768,135 A * 6/1998 Park et al. ..... 700/130
5,956,525 A * 9/1999 Minsky ..... 396/3

* cited by examiner

*Primary Examiner*—John Calvert
*Assistant Examiner*—Brian Kauffman
(74) *Attorney, Agent, or Firm*—Pillsbury Winthrop et al.

(57) ABSTRACT

A garment facility produces custom-made garments according to the body contour and the fit preferences of a customer. Marked pieces designed by a tailor are recorded, along with inspection marks, and sent to a cutting machine as digital design data. The inspection marks in the digital design data are used to ensure proper cutting of the custom-made garment pieces. The completed custom-made garment is also inspected using the inspection marks.

112 Claims, 20 Drawing Sheets custom-made garment facility 100

FIGURE 2 – Try-on Garment (200)

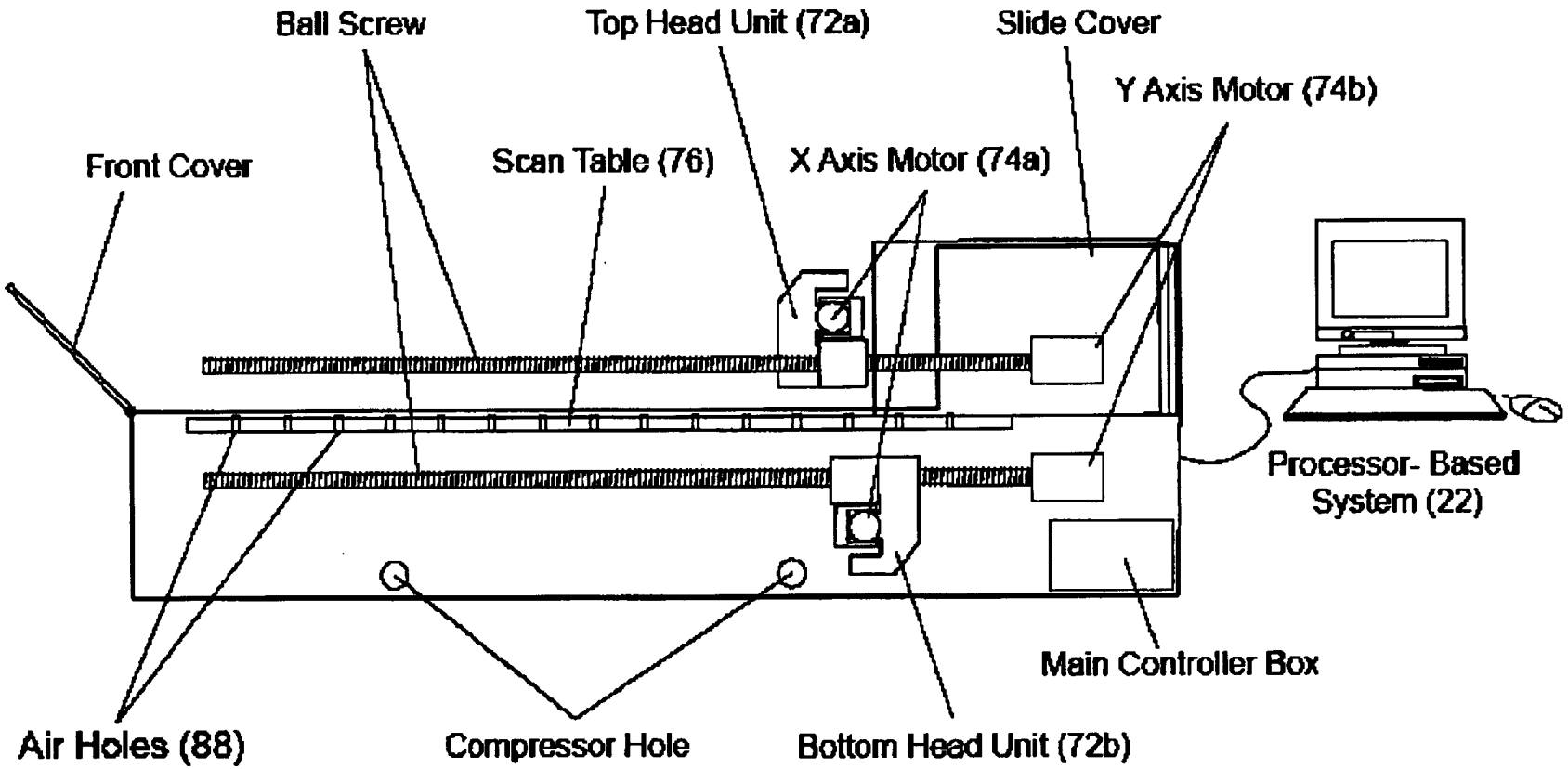
Figure 4A – Scanner System (10)

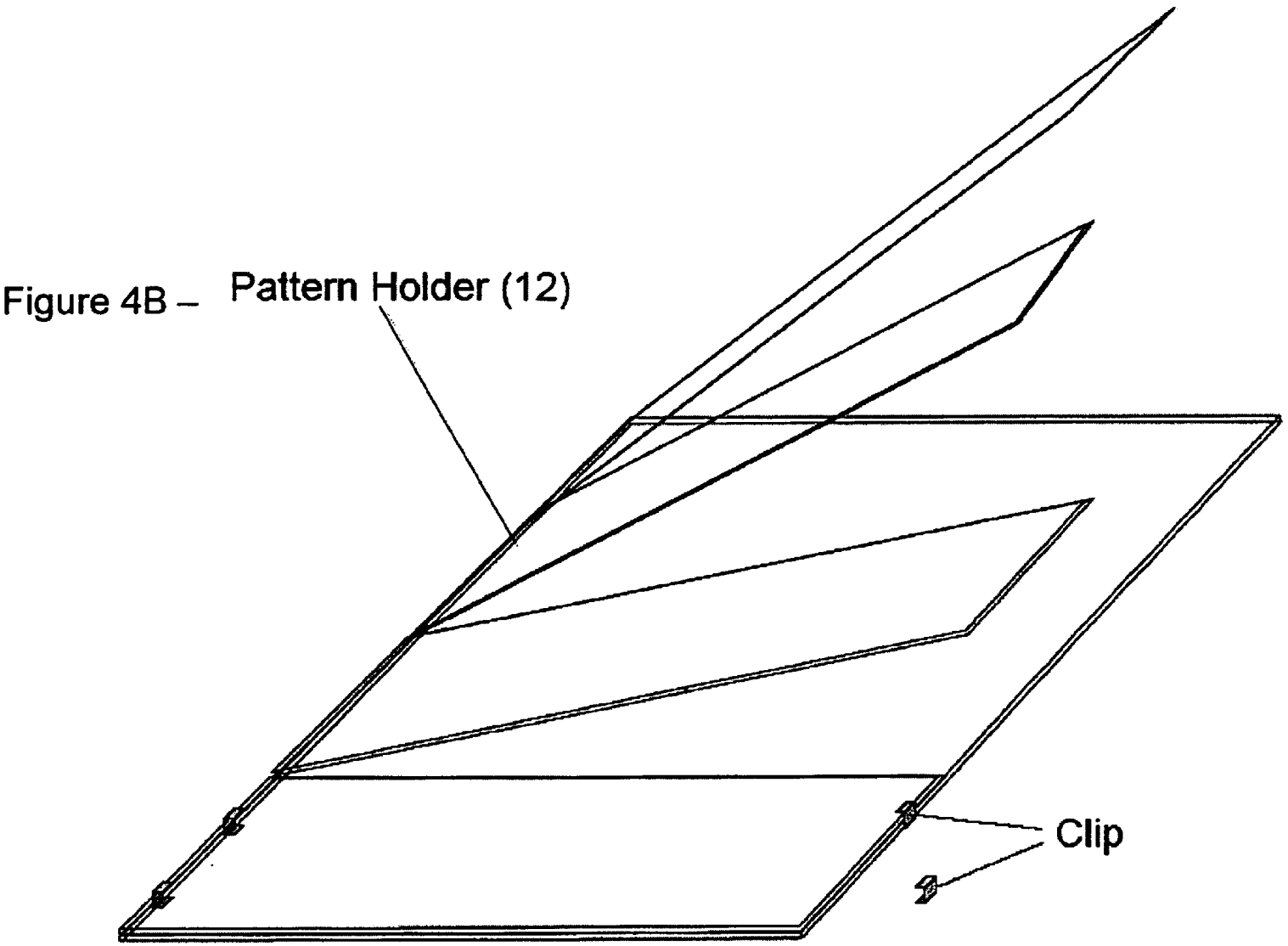
Figure 4B –

SYSTEM AND METHOD FOR INSPECTING CUSTOM-MADE CLOTHING

RELATED APPLICATION

The present application is a continuation-in-part application of, and claims the benefit of priority from, commonly-owned U.S. patent application Ser. No. 10/342,671 (hereinafter "the '671 application") to John S. Watanabe, filed Jan. 14, 2003 entitled "System and Method for Custom-Made Clothing," which is incorporated herein by reference in its entirety and for all purposes.

FIELD OF THE INVENTION

This invention generally relates to the manufacture of clothing and, more particularly, to a system and method for producing and inspecting custom-made clothing using digital design data.

BACKGROUND OF THE RELATED ART

One of the ways the clothing industry seeks to be profitable is by mass-producing garments in only a few sizes. T-shirts, for example, usually are available in small, medium and large sizes. One-size-fits-all is a familiar sizing option for some garments as well.

Even where ten or more garment sizes are offered for sale, many customers seem not to fit into any of the available sizes. Consider, for example, a customer with a large waist and thin legs. Since the waist size is large, the customer is more likely to regularly find pants that are too loose on the legs or too tight in the waist. Also, the customer may find pants that will fit, but may not prefer the pants design.

Some changes are evident in the clothing industry. Some garment stores, for example, offer pants in many different styles, hoping to fit a larger percentage of customers. Still, the almost infinite variety of body sizes and fit preferences frustrate the ability to satisfy all customers.

Some garment manufacturers offer custom-fitting facilities, in which a customer either visits a sizing location or submits size data to the facility. For on-site service, a variety of sizing methods can be employed, from computer-directed body scanning techniques to the use of a tape measure. Once the body contour of the customer is established, a customer-specific garment can be produced.

Unlike mass manufactured garments, where textures are piled and pattern pieces (i.e., designed texture pieces) are cut out in mass, custom-made garments require each pattern piece to be cut out to a unique design. That unique design incorporates the size, shape and preferences of the customer for whom the garment is being made. Currently, these custom-made pattern pieces are often cut manually, piece by piece, and pattern pieces and garments (i.e., connected pattern pieces) are mostly inspected by manual means, or visual human inspection.

As with all manual, human manufacturing processes, the manual cutting and visual inspection process in the custom-made garments industry is tedious and time consuming, and marginally reliable at best. This unreliability is because the pattern pieces and garments at the manual visual inspection process require varying human judgment, even for similar quality standards. Further, unlike the inspection of mass-produced clothing where inspections are made against a static design, custom-made clothing are inspected against unique designs. This constantly changing unique design inspection frustrates the speed and accuracy with which the manual visual inspection process can be accomplished for custom-made clothing.

Some manufacturers have attempted to speed up pattern piece garment inspection. For example, U.S. Pat. No. 5,664,512 ("the 512 patent") describes a vision and control system that produces an X-axis and Y-axis accept/reject reference, where the two axes are based on a corner point in the pattern piece and cut lines extending from the corner point in a 90 degrees cut angle. However, if a cut pattern piece does not have a corner point (e.g., a rounded pocket piece for pants, a hat piece, etc.), reference point cannot be located and inspection using X-Y axes cannot be conducted. Moreover, even if the pattern piece were to have a corner point, for many, if not most, pattern pieces (e.g., like sleeves, tapered pants legs, etc.), cut lines do not extend from the corner point in a 90 degrees angle, making formation of the reference X-Y axes using cut lines less possible.

A further drawback of using X-Y reference axes defined by a corner point with a 90 degrees cut angle is that inspection error will more likely be induced by this method. For example, consider a pattern piece that is shaped as shown in FIG. 14, having one 90 degrees cut corner and straight cut lines on the upper right position. During the cutting process, the 90 degrees corner has been mistakenly cut in a slightly skewed manner, but maintaining the 90 degrees corner and the straight cut lines. The pattern piece as a whole is within the design tolerance, but when X-Y axes are created from this corner point and inspected using the methodology of the '512 patent, the further away from the reference corner point, the more gap will result between the actual pattern piece position and the expected position, inducing an inspection error. This error-induction at inspection will hinder the production process and greatly increase the cost of the finished garment.

Because of the slow, tedious and inaccurate manual visual inspection process involved in the production of custom-made garments, custom-made garments tend to take longer to produce, which is one of reasons why they are more expensive than similar mass produced garments. Thus, for custom-made garments to more effectively compete with mass produced garments, the time to produce, which is driven by the time and accuracy to inspect must be reduced.

What is needed, then, in the custom-made garment industry is an improved method of inspecting custom-made pattern pieces and garments with precision and speed.

SUMMARY OF THE INVENTION

According to the embodiments described herein, a method is disclosed in which a try-on garment is created from a plurality of base patterns, the base patterns are retrieved and marked according to the body shape and fit and/or style preferences of a customer, then modified and connected to create a sample garment based on the marks, and the marked sample garment is scanned to generate customer data. The method further comprises cutting material for a custom-made garment based on the customer data and sewing the cut material together to form the custom-made garment.

Further, a system for producing custom-made garments is disclosed comprising a plurality of try-on garments, wherein each try-on garment associate with one or more pieces of base patterns to be modified and connected together to create a sample garment for sizing on a customer; and a recording system comprising at least one imaging device and the one or more pieces of the sample garment are recorded by the imaging device as digitized data. In some embodiments, the system further comprises a cutting machine, which cuts fabric based upon the digitized data. The system may further comprise a pattern holder for maintaining the positions of the one or more pieces of the sample garment during the recording operation.

Advantages and other features of the invention will become apparent from the following description, the drawings and the claims.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein:

FIG. 4A is a side-view diagram of a scanner in accordance with an embodiment of the present invention to be used in one example of the custom-made garment facility of FIG. 1;

FIG. 4B is a perspective drawing of a pattern holder in accordance with an embodiment of the present invention to be used in one example of the custom-made garment facility of FIG. 1;

DETAILED DESCRIPTION

The present invention will now be described in detail with reference to the drawings, which are provided as illustrative examples of the invention so as to enable those skilled in the art to practice the invention. Notably, the figures and examples below are not meant to limit the scope of the present invention. Moreover, where certain elements of the present invention can be partially or fully implemented using known components, only those portions of such known components that are necessary for an understanding of the present invention will be described, and detailed descriptions of other portions of such known components will be omitted so as not to obscure the invention. Further, the present invention encompasses present and future known equivalents to the known components referred to herein by way of illustration.

Generally, in accordance with the embodiments described herein, a garment facility produces custom-made garments according to both the body contour, fit and style preferences of a customer. Sample garments, made by connecting one or more base patterns together, are made available to the customer for fitting.

Each sample garment is made from base patterns that have been marked and modified by tailors or other persons associated with the facility, according to the desired fit and the body contour of the customer. The marked garments are then scanned and information corresponding to the marks and desired modifications are recorded and sent to a cutting machine as digital design data. Material for the custom-made garment is then cut and inspected according to the digital design data and the cut items are sewn together to form the custom-made garment. The finished garment can be further inspected according to the digital design data. During inspection process, inspection marks will be used to facilitate an acceptably high level of quality control.

Figure 1:
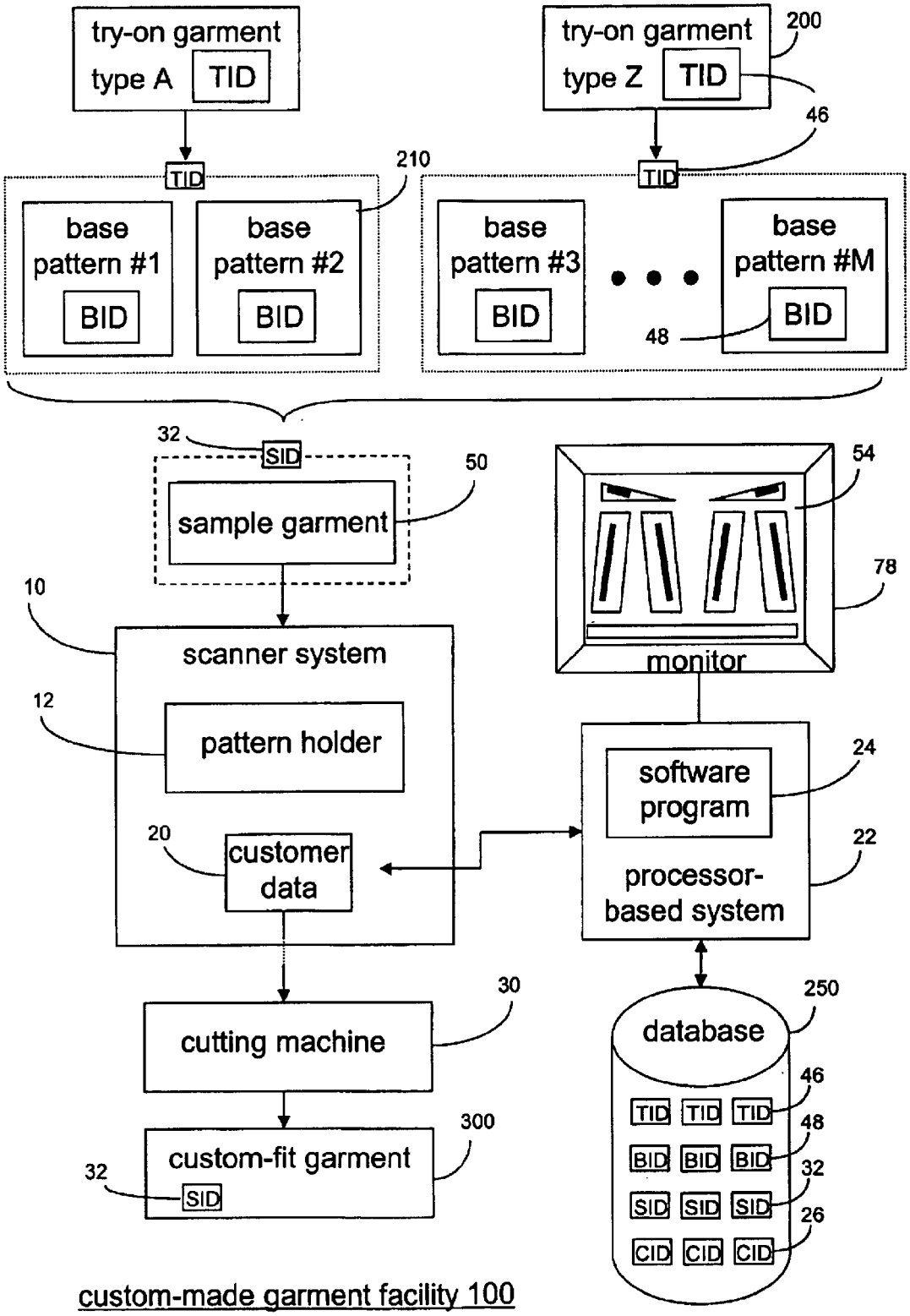
FIG. 1 is a schematic diagram of a custom-made garment facility according to an embodiment of the invention.

In FIG. 1, one example of a custom-made garment facility 100 according to the invention is depicted for producing custom-made garments. The custom-made garment facility 100 includes multiple try-on garments 200, each associated with a set of one or more design-adjustable base patterns 210. A sample garment 50, produced from pieces of one or multiple base patterns 210 (typically associated and retrieved from one try-on garment 200 but possibly several), is scanned by a scanner system 10, and the scanned image of sample garment 50 is digitized for storage and subsequent retrieval as customer data 20. This customer data 20 may be immediately provided to a cutting machine 30, to produce a custom-fit garment 300 according to the customer's body contour and fit preferences or retrieved at a later time for reproduction of the garment. Preferably, cutting machine 30 is housed in the same location as scanner system 10, but may alternatively be placed at a remote location.

Figure 2:
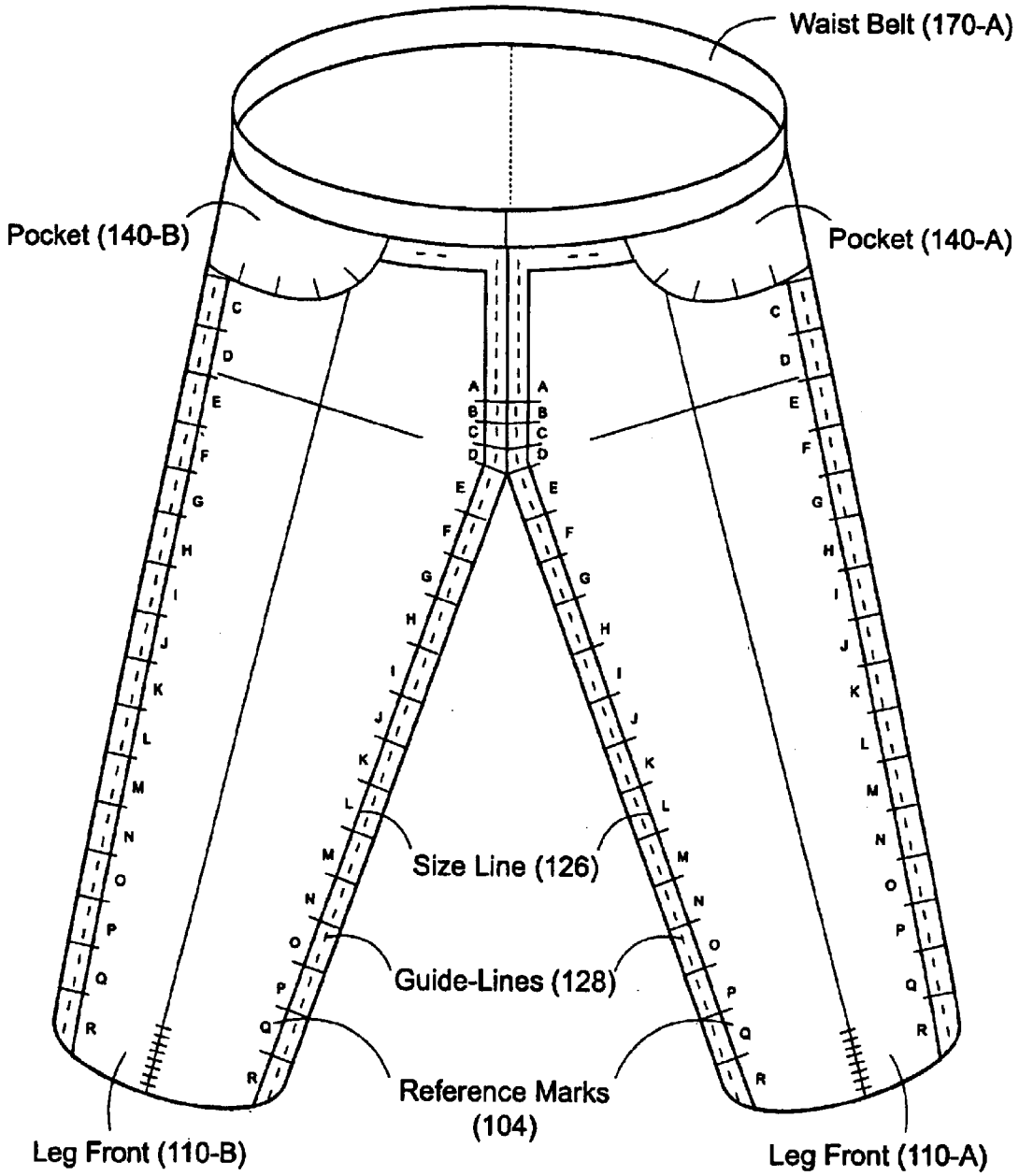
FIG. 2 is a diagram of a try-on garment for a pair of pants in accordance with an embodiment of the present invention to be used in one example of the custom-made garment facility of FIG. 1.

As referred to herein, a base pattern 210 is an individual pattern piece comprising the try-on garment 200, such as a left leg front, a back yoke, and so on. For example, a base pattern 210 for the try-on garment 200 illustrated in FIG. 2 (e.g., a pair of pants) may be a front left leg piece, a front right leg piece, a back left leg piece (not shown), a back right leg piece (not shown), a left back yoke piece (not shown), a right back yoke piece (not shown), a waistband piece, front pocket pieces, and back pocket pieces (not shown).

Although depicted as a contiguous entity, the custom-made garment facility 100 can be physically distributed as two or more separate facilities. Accordingly, for example, the customer data 20 produced by a scanner system 10 and computer system 22 at one site can be sent to a remote site where cutting machines 30 are operated, such as in a factory environment. Further, the computer system 22 can be distributed among different sites. Moreover, some or all of the scanner system 10 and computer system 22 (e.g., a processor for executing one or more of the programs 24) can be combined in one unit.

In one embodiment of the present invention, a unique try-on garment identifier (TID) 46 is associated with each try-on garment 200 and a unique base pattern identifier (BID) 48 is associated with each base pattern 210. The TID and BID are printed on or attached to the try-on garment 200 and base pattern 210 where they will be visible. Each TID 46 and BID 48 is preferably stored in a database 250, accessible to the custom-made garment facility 100. As used herein, database 250 refers to a storage device such as a hard disk drive, an optical disk drive such as CD-ROM or DVD-ROM, tape media drive, or other storage device, whether or not structured as a database with associated database software (e.g., Oracle or Microsoft Access).

Figure 3:
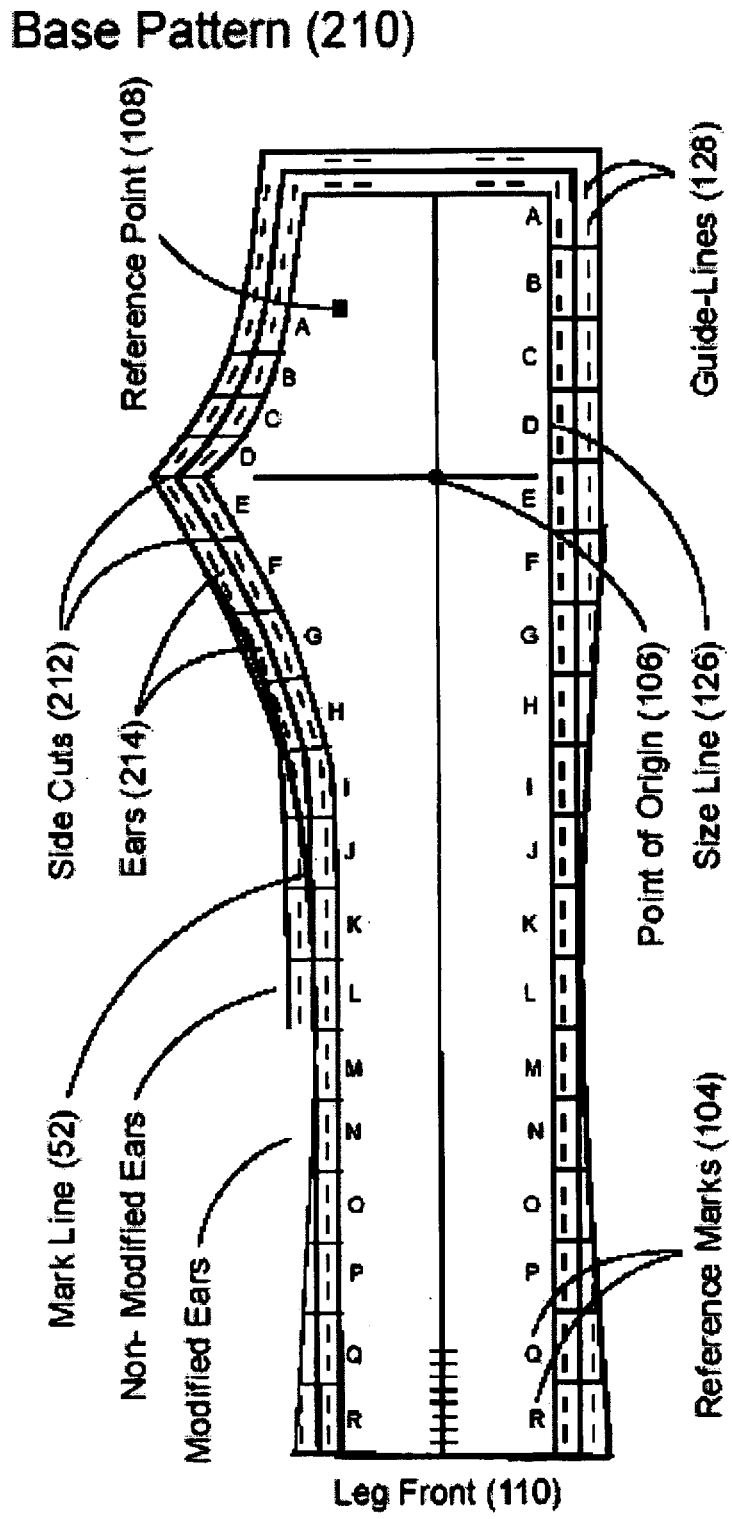
FIG. 3 is a diagram illustrating how a base pattern is modified in accordance with an embodiment of the present invention.

According to another aspect of the invention, each base pattern 210 can be a design-adjustable pattern piece. In the example shown in FIG. 3, base pattern 210 has a plurality of side cuts 212 cut into the outer periphery of at least part of the fabric and creating one or more ears 214. The ears are flexible so that by folding each ear, the base pattern's design can be modified. For example, the bottom left ears have been modified to define a flare in the bottom pant leg in FIG. 3. Depending on the garment's texture and design, the side cuts' length, shape, number and position can differ.

During the marking process of the base pattern 210, care must be taken so that the mark lines 52 are marked on the ears 214 where the base pattern will be modifiable. In addition, the try-on garment 200 and the associated base pattern 210 have reference marks 104 in the same location as to help the tailor locate adjustment points on the base pattern from the try-on garment. For example, as a person (e.g., customer) is trying on a try-on garment 200, a tailor has at his/her disposal, the complete set of loose base patterns associated with that try-on garment. So the tailor can use the reference marks 104 on the try-on garment 200 worn by the customer to locate and identify adjustment points on the loose base patterns in accordance with the person's fit and preferences, without needing to use a tape measure or other methods that are possibly uncomfortable for the customer.

By modifying and connecting the pieces of the one or more base patterns 210 based on the mark lines 52, the tailor produces the sample garment 50. The base pattern pieces are connected together before the sample garment is tried on, such as with thread, snaps, tape, Velcro (trademark of 3M) or other connection means. In one embodiment, base patterns are connected together using thread and a sewing method called a "chain stitch". A "chain stitch" can be made using a factory-type sewing machine, such as those widely used in most garment factories. The chain stitch has one unique point wherein if one thread becomes loose and that thread is pulled, all the thread will come off. Other preferred methods to securely connect and then easily separate the modified base patterns should be apparent to those skilled in the art, such as by using staples. Also, tape or Velcro (trademark of 3M) can be used to position the back pockets.

Depending on the garment's design, the sample garment 50 can be made from a single base pattern 210, or from multiple base patterns 210. Also, since each base pattern is a design-adjustable piece, the same base pattern piece can be modified in different ways to create different styles of sample garments. Moreover, base patterns retrieved from different styles of try-on garments 200 can be modified and selectively connected with one another to create a completely new sample garment. For example, the front legs of the sample garment can come from a first try-on garment-associated base pattern while the back legs of the sample garment come from a second try-on garment-associated base pattern. The custom-made garment facility 100 allows the customer to identify desired features of each possible garment style and use those features interchangeably in producing a sample garment 50 for trying on. For example, a customer can select a try-on garment 200, from which one or more base patterns 210 are retrieved, and the customer can also discuss with the person associated with garment facility 100 how the customer wants to modify them to obtain desired features.

During a customer order process (including the selection of a try-on garment 200, and the mark-up of its associated base patterns 210 as set forth above), a unique sample garment identifier (SID) 32 is assigned to the final sample garment 50, in one embodiment. As with the unique try-on garment identifier (TID) 46 and the unique base pattern identifiers (BID) 48, each SID 32 is stored in the database 250. In one embodiment, when the custom-made garment 300 is ultimately produced, its associated SID 32 will be printed on or attached to the garment, as will be described in more detail below. At a later time, the SID 32 can thus be readily obtained and used to retrieve the sample garment data so as to reproduce the sample garment for a new custom fitting, or for reorder of the custom-made garment 300. In addition, each customer will be assigned a unique customer identifier (CID) 26, when ordering a first custom-made garment from sample garment 50 for example. When pattern pieces are cut, the SID 32 and CID 26 can be printed on or attached to each pattern pieces to help keep track of those pieces, as will be described in more detail below.

The composition of the sample garment 50, which includes the inspection marks (point of origin 106, reference point 108, and reference lines 112, 114), is maintained in the database 250. Furthermore, in one embodiment, the database 250 is network-accessible, such that the database is available to employees of the custom-made garment facility who may operate in remote locations worldwide. Also, a customer will be able to re-order the custom-made garment via a data communications network such as the Internet. Security measures, well known to those in the industry, can be provided to limit access to the information in the database 250 to only those so authorized.

Ideally, try-on garment identifiers (TIDs), base pattern identifiers (BIDs), sample garment identifiers (SIDs), and customer identifiers (CIDs) are relationally linked in the database. The CID for a customer can be linked to the BIDs and SIDs agreed upon during the fitting operation, but individual customer information assigned to each CID contained in the database 250 would not be readily accessible by others. However, the association of a CID with a particular BID or SID does not preclude the BID or SID from being used by another customer. In other words, once a base pattern/sample garment arrangement is stored in the database, it may potentially be used by customers other than the original customer.

Once the various marked-up and modified base pattern pieces are connected and fitted on the customer, and the customer agrees with the fit and design, the sample garment 50 is disassembled for scanning by scanner system 10. The scanner system is used to identify the mark lines 52, fixed reference marks (e.g., size lines, inspection marks, etc.) and other markings made by the tailor (e.g., easing amount/position, etc.) on each piece and, accordingly, produce digital design data, shown as customer data 20. In one embodiment, digital design data that represents the design of each pattern piece constructing the sample garment will be preserved together in the customer data 20.

Referring back to FIG. 1, a computer system 22 is connected to the scanner system 10, in one embodiment. The computer system 22 can be a personal computer or other processor-based system, such as a desktop, a laptop or tablet PC, for executing software instructions. The computer system can include an input device (not shown), such as a keyboard, a mouse, or a touch panel pen, with which the tailor can adjust the mark lines before the customer data 20 is generated. The computer system can further include a video panel or monitor 78 to display the scanned images of the various patterns comprising customer-marked sample garment 50.

The computer system 22 preferably includes one or more software programs 24 that control the operation of the scanner, and retrieve the image output therefrom in order to identify the mark lines 52 and inspection marks. The scanner's operation can be controlled in basically the same manner as typical document scanners commonly used with computer systems today (except that the scanner of the present invention can include top and bottom scan cameras and a top head ink jet printer as will be described in more detail below).

Accordingly, programs 24 can include interface and control programs, adapted from or known to those of skill in the art, to control the scanner system 10 and to send appropriate commands to the scanner system 10. In one example operation of program 24, first it will cause the scanner system 10 to make a rough scan of the entire scan table 76 and to display the whole scanned image on the monitor 78. Next, a tailor can specify the area that needs to be scanned in more detail (e.g., the area including only one of the pattern pieces when multiple pattern pieces are placed on the table 76) and the program 24 will cause scanner system 10 to start the detail scan operation. The detail scan output image data can then be converted to a proprietary or standard format such as JPEG, TIFF or DXF (DXF is a format widely used in the CAD industry), preferably one that is able to handle color images.

According to one aspect of the invention, the reference marks 104, guide lines 128, size lines 126, inspection marks (point of origin 106, reference point 108, reference lines 112, 114), and mark lines 52 can differ in colors or shapes so as to be manually distinguished from each other by persons associated with the custom-made facility 100. Alternatively, the different types of marks can be distinguished from each other automatically by computer program 24 (for example, commercially available image editors such as Adobe Photoshop (trademark of Adobe Systems Inc. of San Jose, Calif.) can distinguish lines by color and so a full-auto program can be developed). In a preferred embodiment, computer program 24 is one program or complete set of programs that can both control the operation of scanner system 10, retrieve and convert the scanned image data to a desired file format, distinguish the mark lines from other lines and markings in the scanned image, and further adjust the mark lines as will be described in more detail below. Alternatively, separately available programs such as Adobe Photo Shop and Adobe Illustrator (trademarks of, and available from, Adobe Systems Inc. of San Jose, Calif.), which include routines that can recognize the mark lines by contrasting the color with the background color of the sample garment pieces, can be used along with other commercially available or proprietarily developed programs.

One possible scanner system for use in the present invention is depicted in FIG. 4A. The scanner includes motors 74, which operate one or more scanner heads 72. One motor 74*a* controls movement of the scanner head 72*a* in one direction (e.g., the X-axis), while the other motor 74*b* controls movement of the scanner head 72*b* in a second direction (e.g., the Y-axis). The scanner heads 72 provides one or more cameras for acquiring the image of a garment. Optionally, one or more top scanner heads can also be fitted with an ink jet head, such as for further marking the garment, as will be described in more detail below.

In one embodiment, the scanner system 10 comprises a transparent table surface 76 and two cameras (stored within the head units 72), one positioned above the table (head unit 72*a*) and one positioned below the table (head unit 72*b*). By positioning the pattern pieces on the transparent table, both sides of the pattern pieces can be scanned simultaneously. Alternatively, a first camera scan can be made, and then a second scan is made. In one example, the table includes air holes 88 connected to a vacuum or compressor (not shown) for producing suction against the pattern pieces. This prevents the pattern pieces from moving during the scanning operation.

Referring now to FIG. 4B, an alternative embodiment of scanner system 10 could further include a pattern holder 12, to hold the pattern pieces in a flat position. Pattern holder 12 is preferably constructed, using. Plexiglas for example, as a flat, transparent containment vessel, inside which one or more of the various pattern pieces are positioned. The pattern holder 12 can be arranged in different ways to hold the pattern pieces properly. In using a pattern holder 12, a single camera scanner system may be used. After scanning one side of the pattern, holder 12 could be flipped to allow the opposite side to be scanned. Care must be taken to ensure that the pieces of the pattern do not move between scans. Those of ordinary skill in the art recognize that a number of mechanisms for recording visual images are available, and that reference to scanners in the description represents but one of many possibilities for practicing the invention.

Figure 5A:
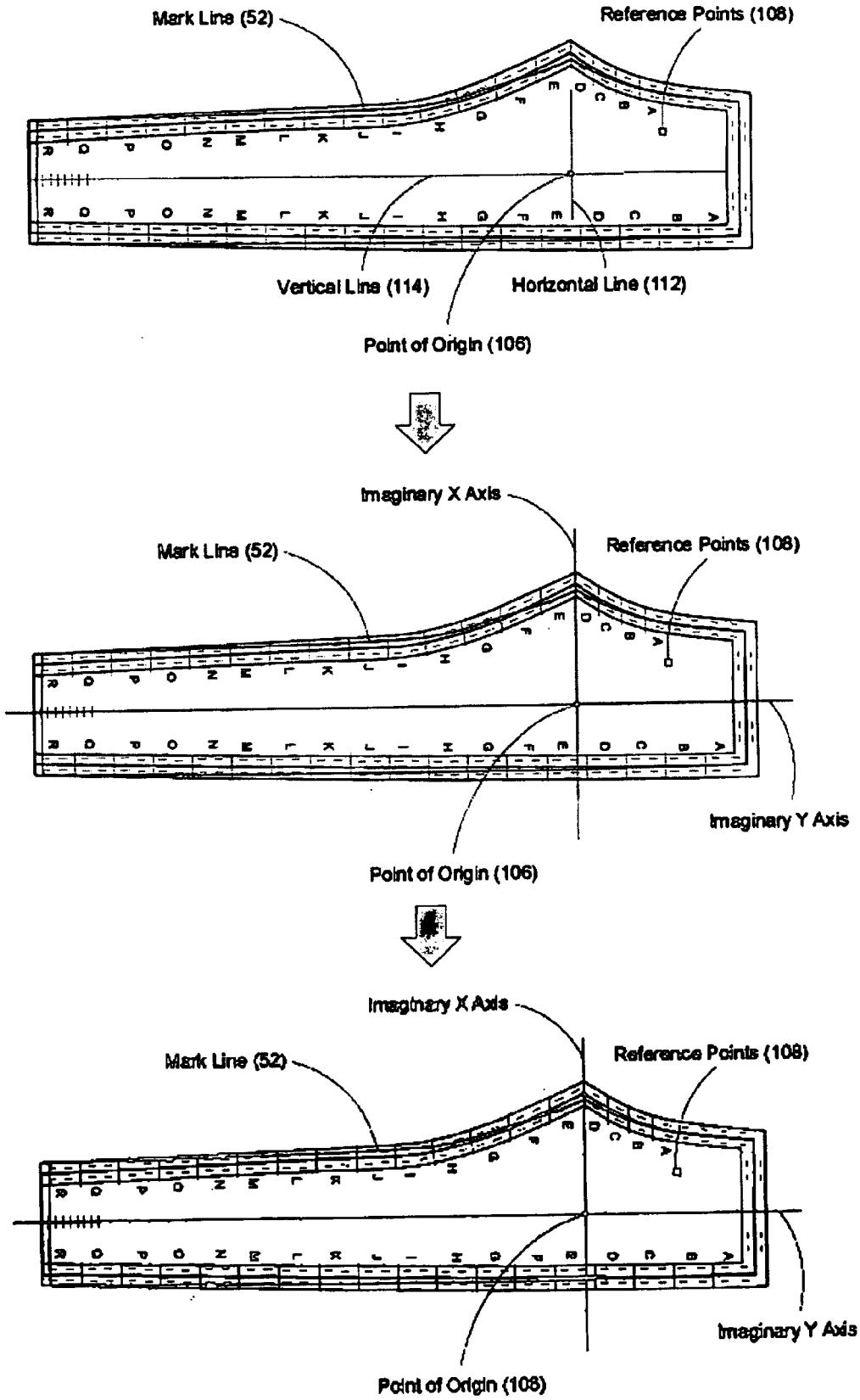
FIGS. 5A and 5B are schematic diagrams illustrating the creation of imaginary X-Y axes on the base patterns in accordance with an embodiment of the present invention to be used in one example of the custom-made garment facility of FIG. 1.
Figure 5B:
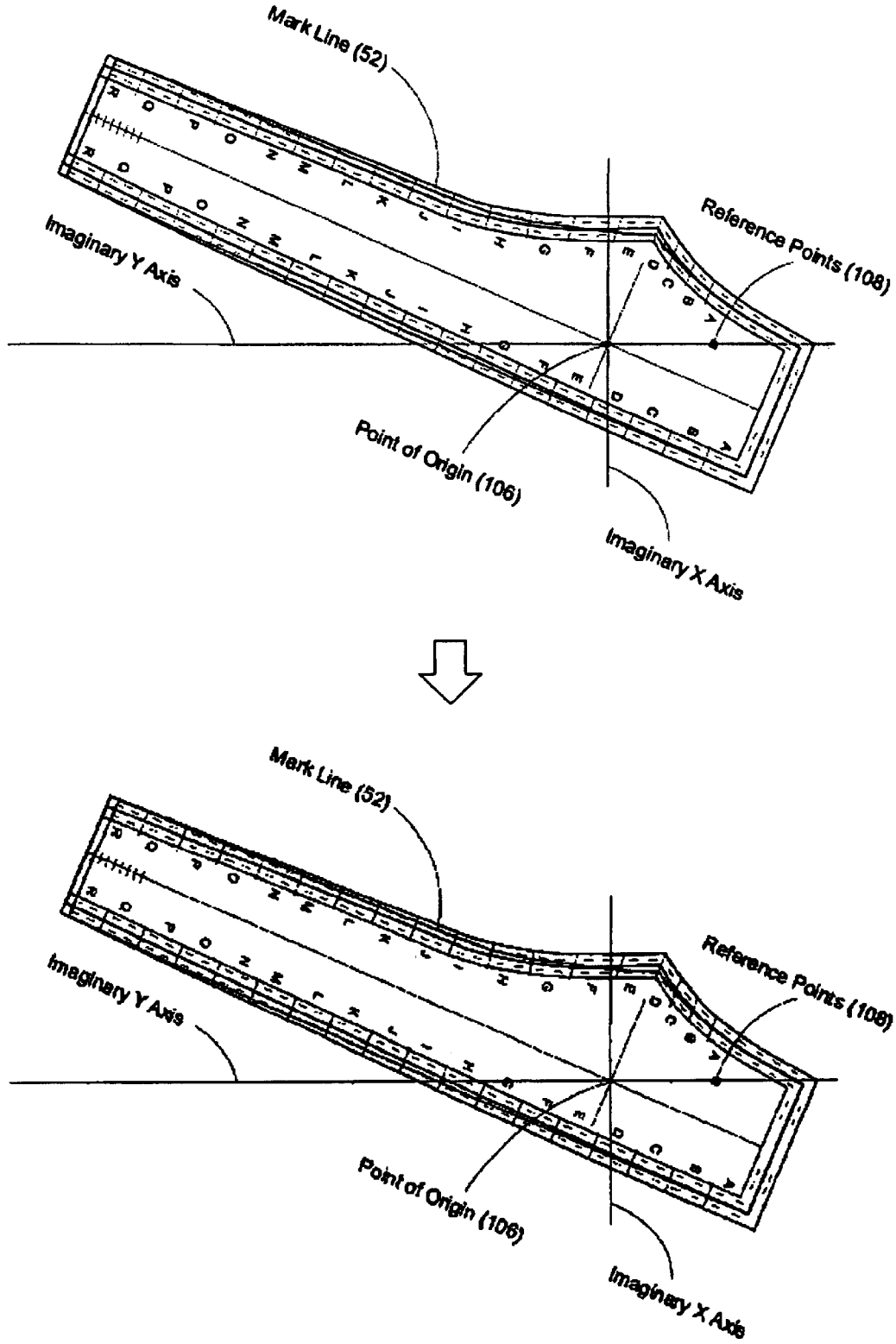

As previously discussed, the image data 54 includes scanned inspection marks. FIGS. 5A and 5B illustrate two examples of inspection marks on a pattern piece as contemplated by the present invention. The inspection marks include a point of origin 106, reference point 108, and horizontal 112 and vertical 114 reference lines on the pattern piece. By using a software program 24, imaginary X-axis and Y-axis are derived by using the inspection marks, and the derived imaginary X-axis and Y-axis will translate the mark lines 52 on the base pattern into X-Y coordinate data, which can be used to cut and inspect the pattern piece, as will be described in more detail below.

As shown in FIG. 5A, the imaginary X-Y axes are created using the horizontal 112 and vertical 114 reference lines, in one embodiment. As shown in FIG. 5B, the imaginary axes can be derived from two points on the pattern piece, the point of origin 106 and reference point 108, in another embodiment. In this example, one of the imaginary axes can be derived by creating a straight line that includes both the point of origin and the reference point. The other imaginary axis can be derived by creating a line perpendicular to the first line and intersecting the first line at the point of origin. Those of ordinary skill in the art recognize that any two points located anywhere on the pattern piece can be the point of origin and the reference point, and that reference to inspection marks includes enough information by which to derive an imaginary X-axis and Y-axis on the pattern piece with the point of origin at their intersection.

Figure 6:
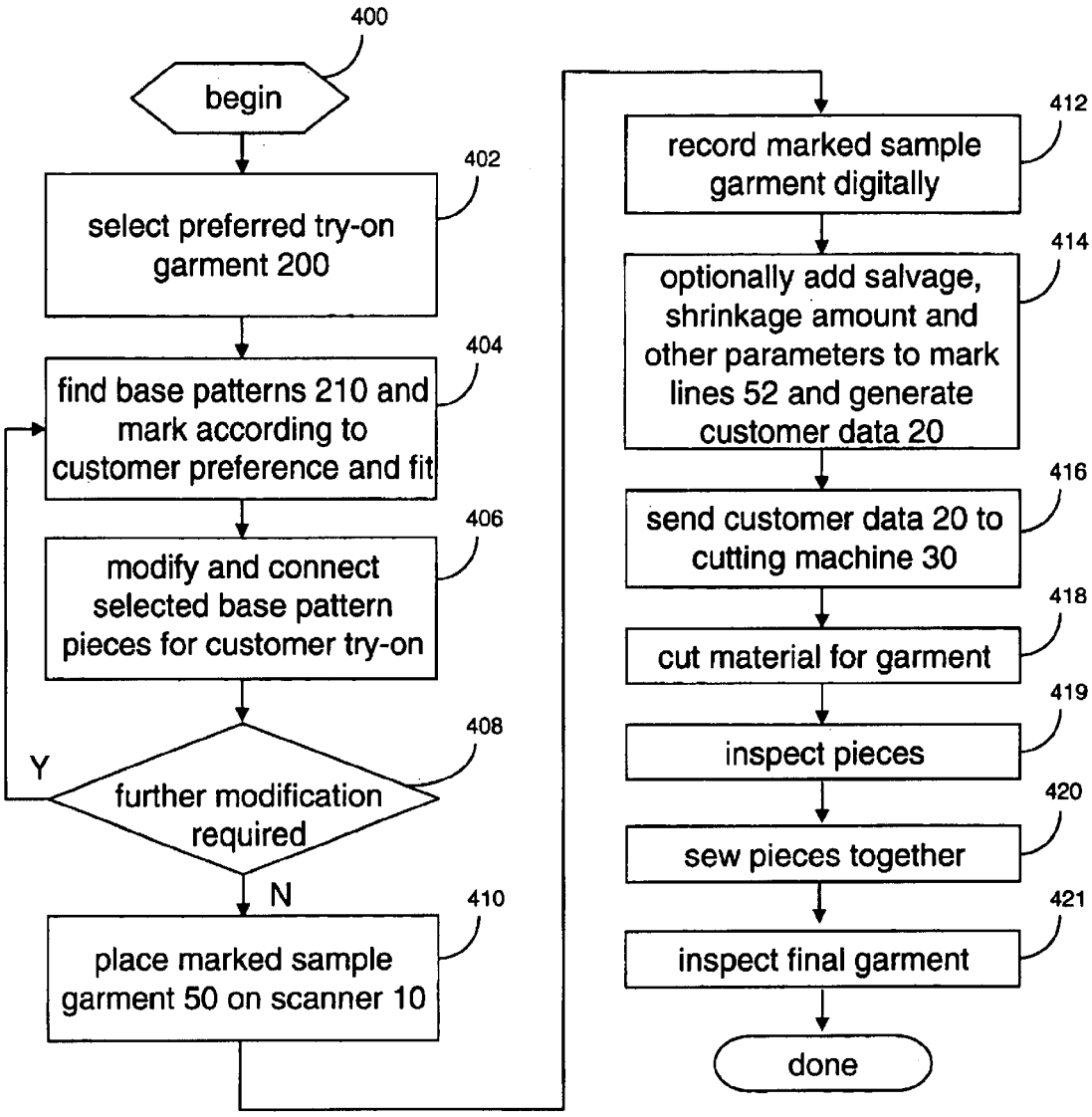
FIG. 6 is a flow diagram illustrating operation of the custom-made garment facility of FIG. 1 in accordance with an embodiment of the present invention.

FIG. 6 illustrates a flow diagram that describes an example operation of the custom-made garment facility 100, according to one embodiment. Initially, the customer selects a try-on garment 200 (block 402), from which one or more associated base patterns 210 are retrieved. The base patterns 210 are marked by a tailor (block 404), as described above, to account for the customer's body contour and preferences in fit and style. The tailor then modifies and connects the one or more base pattern 210 pieces to create a sample garment 50 that the customer can try on (block 406). In one embodiment, the tailor obtains the one or more base patterns 210 based upon the TID 46 or other identifier stored in the database 250.

Since the sample garment has been modified and connected based upon the customer fit preferences and body contour, no further modification should be required, but if the customer prefers further modification—for example, a snug fit in one section of the garment—the tailor can preliminarily mark the sample garment while on the customer, and then re-adjust the sample garment starting once again from re-marking the base pattern (block 408). Additionally, the customer's preferences for length of the garment, pocket position, pocket shape and other features can be made. Such sizing features are familiar to those of ordinary skill in the clothing industry. The mark lines 52 on each base pattern 210 comprising the sample garment indicate the modification of the design as well as the position of the marked piece in relation to one or more of the other base pattern pieces. Mark lines 52 are preferably made using a highly visible, but erasable or naturally disappearing medium, such as a disappearing Chako pen, chalk, ink, or other medium (available from Adger Kogya Co. Ltd. of Japan) that remains on the base pattern for only a limited duration.

In some prior art custom-fitting operations, a customer wears a sizing garment upon which sizing indicators are present. Sizing indicators can be elaborate, such as using color-coded, alphabetical or numerical markings, and the like. The tailor fits the garment according to the customer preference, and then records the sizing indicators, usually a series of numbers, letters, or other indicia representative of how the pieces of the sizing garment fit relative to one another. The recording may be on a custom-made order form or on a blank slip of paper.

Unfortunately, by recording the sizing indicators only, subsequent inspection of the garment can be checked only with respect to the recorded sizing indicators. Because the sizing indicators were recorded according to a visual inspection, an error is possible, but not discoverable, until the custom-made garment is tried on. In other words, if the tailor or other facility employee incorrectly records the sizing indicators, there is no way to inspect the final product for accuracy.

In contrast, the custom-made garment facility 100 of the present invention records the actual sizing information (e.g., the mark lines 52 for each marked up piece of the sample garment) by producing an actual visual image of the piece. The scanner system 10 thus records the pieces with both the inspection marks and the mark lines thereon. At a later time, the customer data 20 can be retrieved as an actual visual image of what was scanned. Instead of having written information about what the tailor saw (i.e., a translation), the tailor's actual markings on the sample garment pieces are recoverable by the custom-made garment facility 100 for an indefinite period of time.

Returning to FIG. 6, once all of the marks are drawn on each sample pattern piece, the pieces are placed on the scanner (block 410) to generate customer data 20. In one embodiment, the sample garment 50 can be taken apart and each component piece of the sample garment can be scanned individually in two dimensions. Alternatively, holder 12 can be used to hold the sample garment to be scanned without taking the sample garment apart, using a "favorite garment" procedure as will be described below for example. Images of both the mark lines 52 and the pattern pieces are recorded (block 412). If desired, the customer data 20 is modified to account for salvage, shrinkage amount and other parameters (block 414).

Once the customer data 20 is generated by the computer system 22, it is sent to a cutting facility such as the cutting machine 30 (block 416). As mentioned above, the cutting facility can be physically remote from the scanner system 10. Transmitting digital data to a remote facility can be accomplished in numerous ways familiar to those of ordinary skill in the art, such as via a data communications network including the Internet. Once the cutting facility receives the necessary customer data 20, material for the garment is cut (block 418). The cut materials (i.e., material corresponding to each of the customized base pattern pieces 210) are then inspected (block 419) using the customer data 20. Finally, the pattern pieces are sewn together (block 420) in a manner customary in the garment industry to form the custom-fit garment 300, and the final inspection is conducted (block 421).

In one embodiment, the customer data 20 includes a digital design data, a representation of each pattern piece of the customer-marked sample garment 50, as specified by the customer and as enhanced by the tailor and/or software program 24 (including salvage, shrinkage amount, and other parameters). With the customer data 20, the custom-made garment 300 can thus be reproduced at any time. Ideally, no paper pattern is generated for producing the custom-made garment, though one could easily be produced from the customer data 20. Instead, the customer data 20 is sent directly to a cutting machine 30, the desired material for the garment is selected, the inspection marks are marked, and the material is cut using the digital design data preserved in the customer data 20, as will be described in more detail below. Thus, the cutting machine uses the customer data 20 instead of a printed pattern to determine where to cut the material.

Figure 7A:
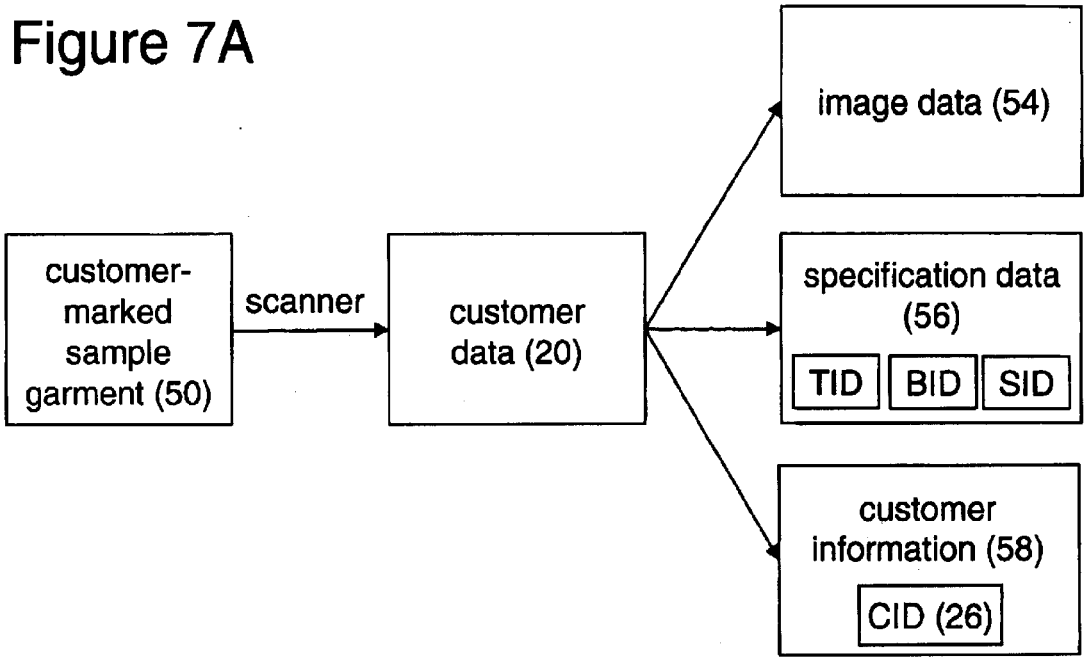
FIG. 7A is a schematic diagram illustrating the recoverability of image data, specification data and customer information from the customer data according to an embodiment of the present invention.

FIG. 7A shows that, as the customer-marked sample garment 50 is scanned into digitized customer data 20, image data 54 corresponding to the sample garment is obtained. Further, non-image data, such as specification data 56, and customer information 58 is generated, in one embodiment. These data are described in more detail below.

Image data 54 generated from customer data 20 may have been modified to include parameters such as salvage, shrinkage amount, easing amount and so on. Thus, the image data 54 can represent a modification of the customer-marked sample garment 50, as originally scanned. However, since additional parameters can be added automatically, such as by the software program 24, or manually, these parameters can likewise be removed automatically or manually. Therefore, the image data 54 can either be a representation of the customer-marked sample garment 50 or the customer-marked sample garment after the additional parameters are included. The specification data 56 is non-visual data that has been added to or extracted from the visual scanned image data 54. Data added to the image data includes the salvage, shrinkage amount, and other parameters that are added to the digital design data to change the mark lines 52, and generated as a modified image data 54 including these parameters. Specification data 56 that has been extracted from the image data include digital design data that indicate length and width of a pattern piece, distance of the mark lines from a point of origin 106 in X-Y coordinates using the inspection marks, and so on. This data can be in a DXF or other file format. In one embodiment, specification data can further include try-on garment identifier (TID), base pattern identifier(s) (BID) and sample garment identifier (SID) to identify try-on garment, base pattern(s) and sample garment, respectively, that have been used and assigned at the time of the customer's order. The customer information 58 is non-visual data that include customer identifier (CID), billing address, shipping address, customer dimensions, customer order history of custom-made garments (SIDs) and so on.

Figure 7B:
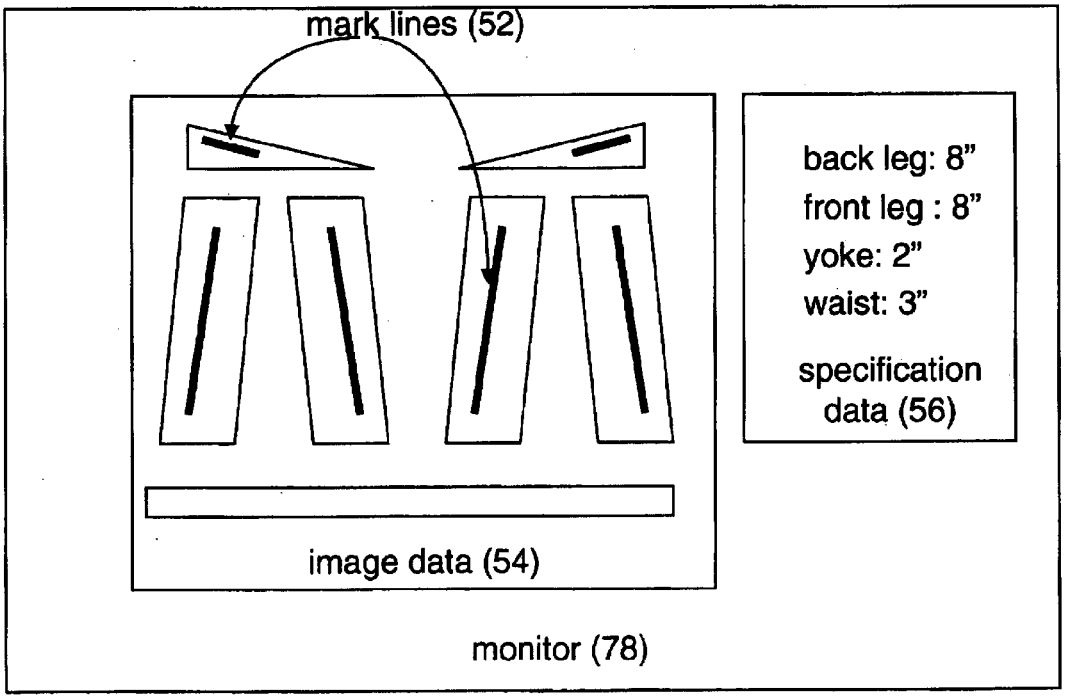
FIG. 7B is a schematic representation illustrating the availability of image data, specification data, and customer information from the customer data according to an embodiment of the present invention.

Because of the ease with which digital data can be reproduced, the image data 54 and the specification data 56 can be retrieved from one or more workstations located at the sewing site. A workstation may be a laptop computer, a personal computer, a mainframe computer/terminal, a personal digital assistant or other processor-based device that is capable of displaying both the image data 54 and the specification data 56. In FIG. 7B, for example, image data 54 and specification data 56 can be presented to the monitor 78, such as a computer display coupled to the processor-based system. Further, multiple workstations (e.g., one or more for cutting and one or more for inspecting) can simultaneously access the image data and the specification data for a single customer, as needed.

Figure 8A:
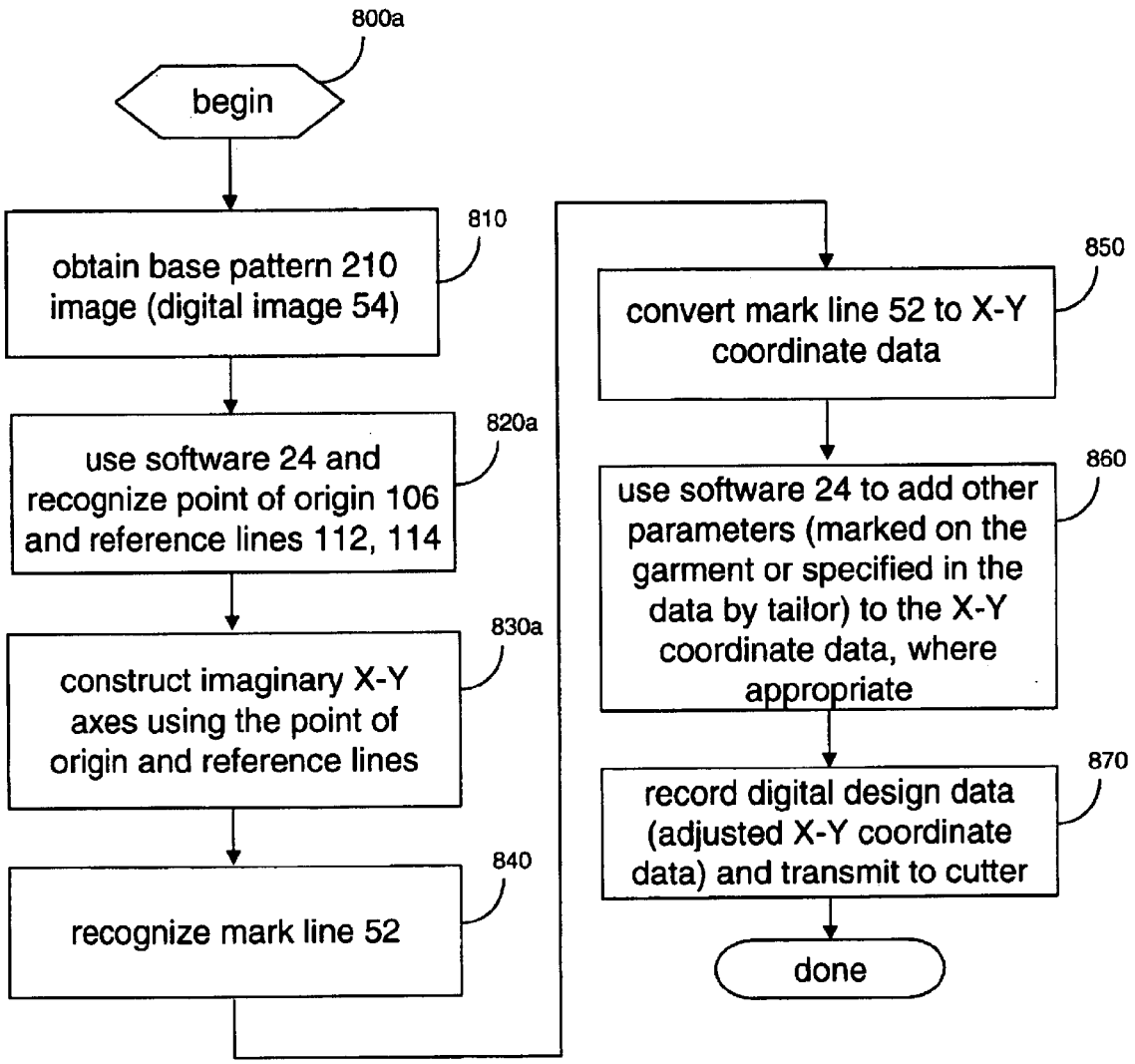
FIGS. 8A and 8B are flow diagrams illustrating operation of one example of the custom-made garment facility of FIG. 1 when X-Y coordinate data is generated from the obtained image data according to an embodiment of the present invention.
Figure 8B:
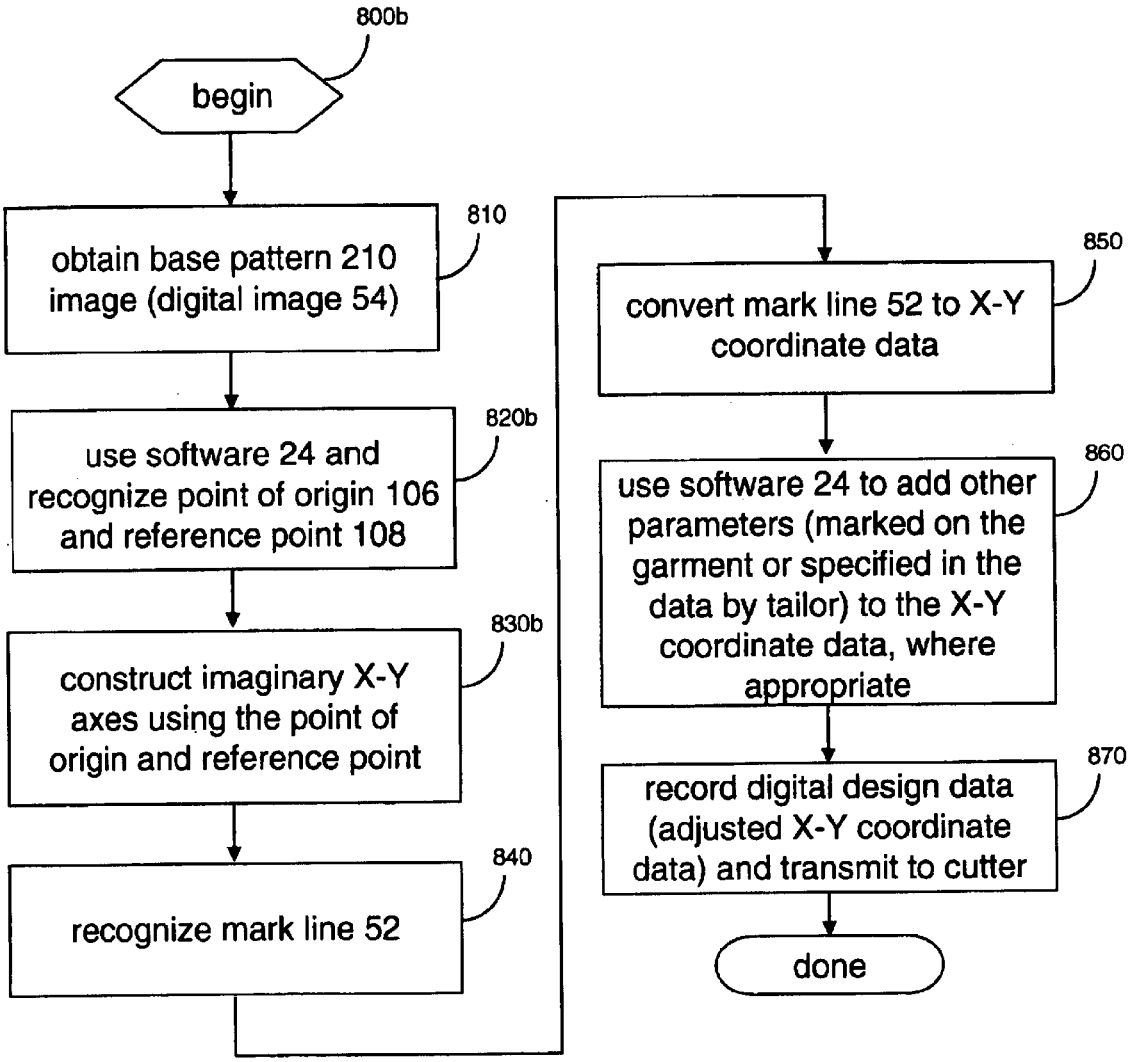
Figure 9:
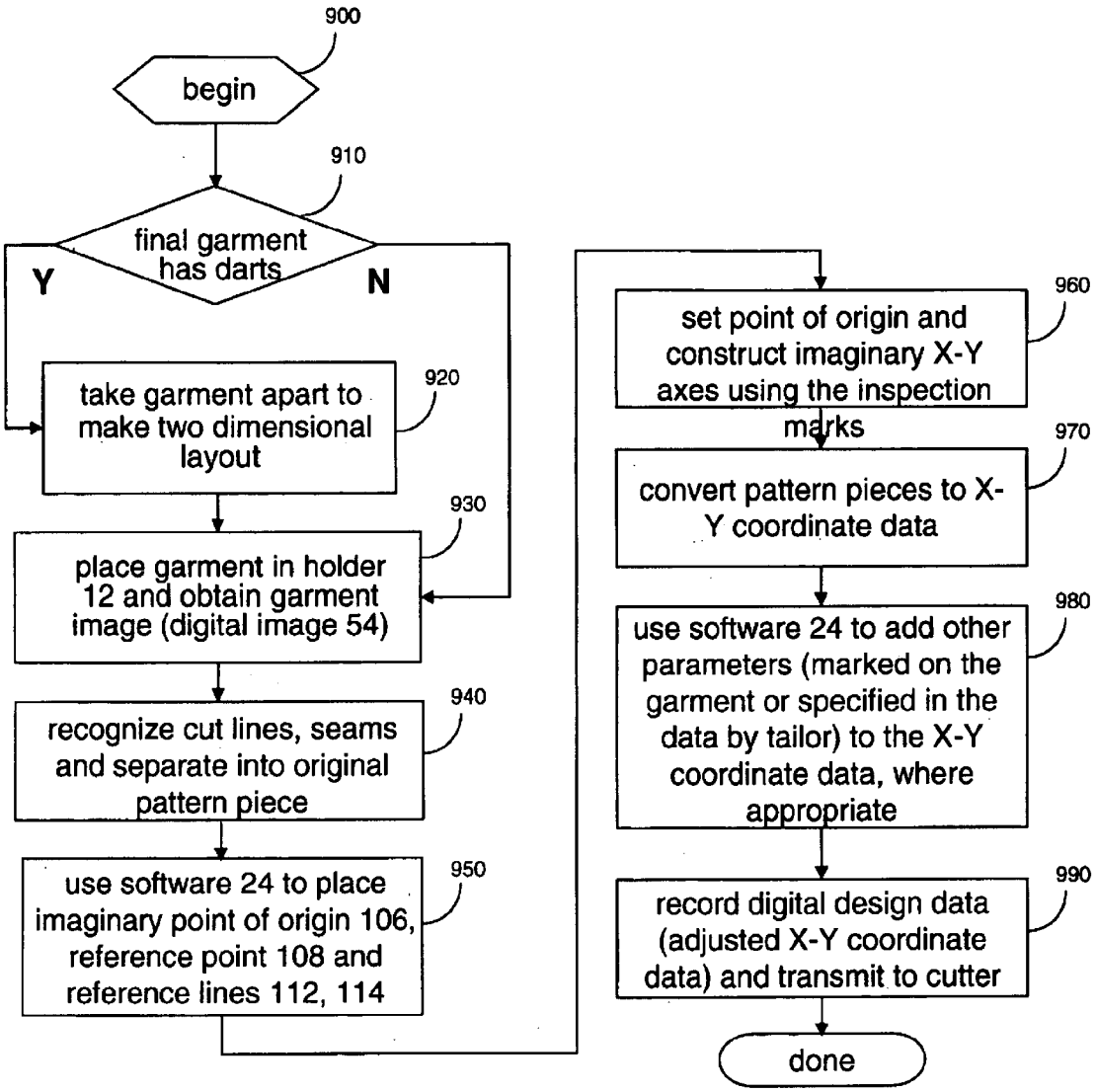
FIG. 9 is a flow diagram illustrating operation of one example of the custom-made garment facility of FIG. 1 when the custom-fit garment is produced from a favorite garment according to an embodiment of the present invention.

To further illustrate how the present invention incorporates inspection marks into the specification data 56 and, ultimately, the customer data 20, consider FIGS. 8A–B & 9, each of which details an embodiment of this aspect of the present invention. As shown in FIG. 8A, the incorporation of inspection marks into the specification data 56 begins with the digital image 54 of the scanned base pattern 210 (step 810). Next, the software 24 recognizes the point of origin 106 and the reference lines 112, 114 (step 820*a*). This recognition step can be either manually directed (e.g., via a facility employee sitting at the workstation) or automatically software driven. Using the point of origin 106 and the reference lines 112, 114, the software 24 constructs imaginary X-Y axes and a corresponding X-Y grid (step 830*a*). Next, the software 24 recognizes the mark line 52 (step 840). Like the point of origin recognition, this step can be either manually or automatically driven. The mark line 52 is then converted to X-Y coordinates using the imaginary X-Y axes and corresponding X-Y grid (step 850). Finally, salvage amount, shrinkage percentage and other parameters (e.g., easing amount marks on garment, other data specified by tailor, etc.) are added to the X-Y coordinate data using the software (step 860) and complete X-Y coordinate data set is recorded as digital design data (step 870). As previously discussed, the digital design data is ultimately preserved in the customer data 20 and is used for cutting and inspecting the cut pattern pieces, and generating modified image data 54 including these parameters.

The embodiment shown in FIG. 8B is identical to that of FIG. 8A, except in how the software 24 constructs the X-Y imaginary axes. As shown in FIG. 8B, this embodiment first recognizes the point of origin 106 and a reference point 108 (instead of reference lines 112, 114) on the base pattern 210 using the software 24 (step 820*b*). Then, using the point of origin 106 and the reference point 108, the software 24 constructs imaginary X-Y axes and a corresponding X-Y grid (step 830*b*). The remainder of this embodiment is as discussed in relation to FIG. 8A.

The processes of FIGS. 8A–B are shown illustratively in previously discussed FIGS. 5A–B. As illustrated in FIG. 5A, using software program 24, imaginary X-Y axis lines will be aligned and extended over horizontal 112 and vertical 114 reference lines. In this embodiment, the reference lines 112 and 114 are in perpendicular relation. So the imaginary X-Y axes are also in perpendicular relation, or can be adjusted by software 24 to be in a perpendicular relation. After the imaginary X-Y axes are constructed, point of origin 106 located at intersection of imaginary X-Y axis, is set as point zero. In FIG. 5B, instead of reference lines 112 and 114, an outer reference point 108 (and point of origin 106) can be used to create the X-Y coordinate data. When using an outer reference point 108, first an imaginary line is drawn between the outer reference point 108 and the point of origin 106. Another line intersecting with the previous imaginary line in perpendicular relation extending from the point of origin 106 is drawn. Imaginary line crossing the reference point 108 can be set as the imaginary X-axis and the other line as the imaginary Y-axis. Also, reference point 108 can be an indication of correct direction of the X-Y coordinate data in one embodiment. For example, reference point 108 can be recorded to be in "X=minus, Y=plus" position from the point of origin. By recording this position, the four potential orientations (i.e., directions) to align the X-Y coordinate data to the inspection marks will only have one possibility. Furthermore, the outer reference point and the point of origin can be distinguished by, for example, a different size, shape or color.

FIG. 9 illustrates a further embodiment of incorporating inspection marks into the specification data 56. For this embodiment, for example, a customer provides a tailor with a "favorite" garment. Favorite, in this context, is one that the customer would like duplicated as a custom-made garment or one that, because of its style and fit, the customer would like used as a template for a custom-made garment. As shown in FIG. 9, if the final garment has darts (step 910), then it can be taken apart to make it two-dimensional style (step 920) and laid-out in the holder 12 for imaging. After obtaining the garment image 54 (step 930), the software program 24 can automatically or manually find the cut lines and seams of the piece, so that the pattern pieces constructing the garment can be recognized (step 940). Once the pattern pieces are recognized, software 24 places a point of origin 106, reference point 108 and reference lines 112, 114 onto the pattern piece images (step 950). Next, the software constructs the imaginary X-Y axes and the corresponding X-Y grid (step 960) for use in converting the recognized pattern pieces to X-Y coordinate data (step 970). Finally, other parameters (e.g., marks on garment, data specified by tailor, etc.) are added to the X-Y coordinate data using the software (step 980) and complete X-Y coordinate data set is recorded as digital design data (step 990).

Figure 10A:
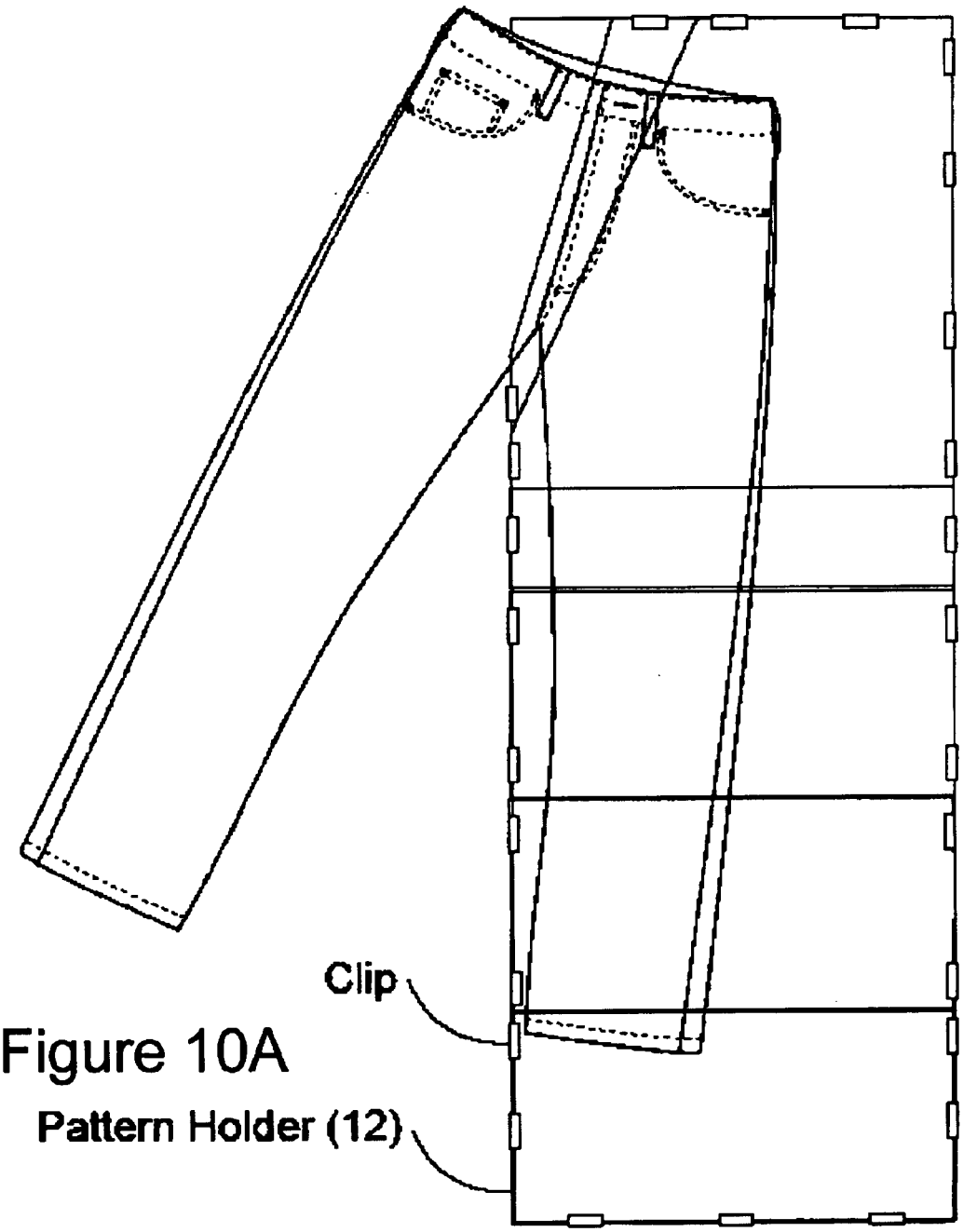
FIGS. 10A and 10B are drawings illustrating a garment before and after scanning according to an embodiment of the present invention.
Figure 10B:
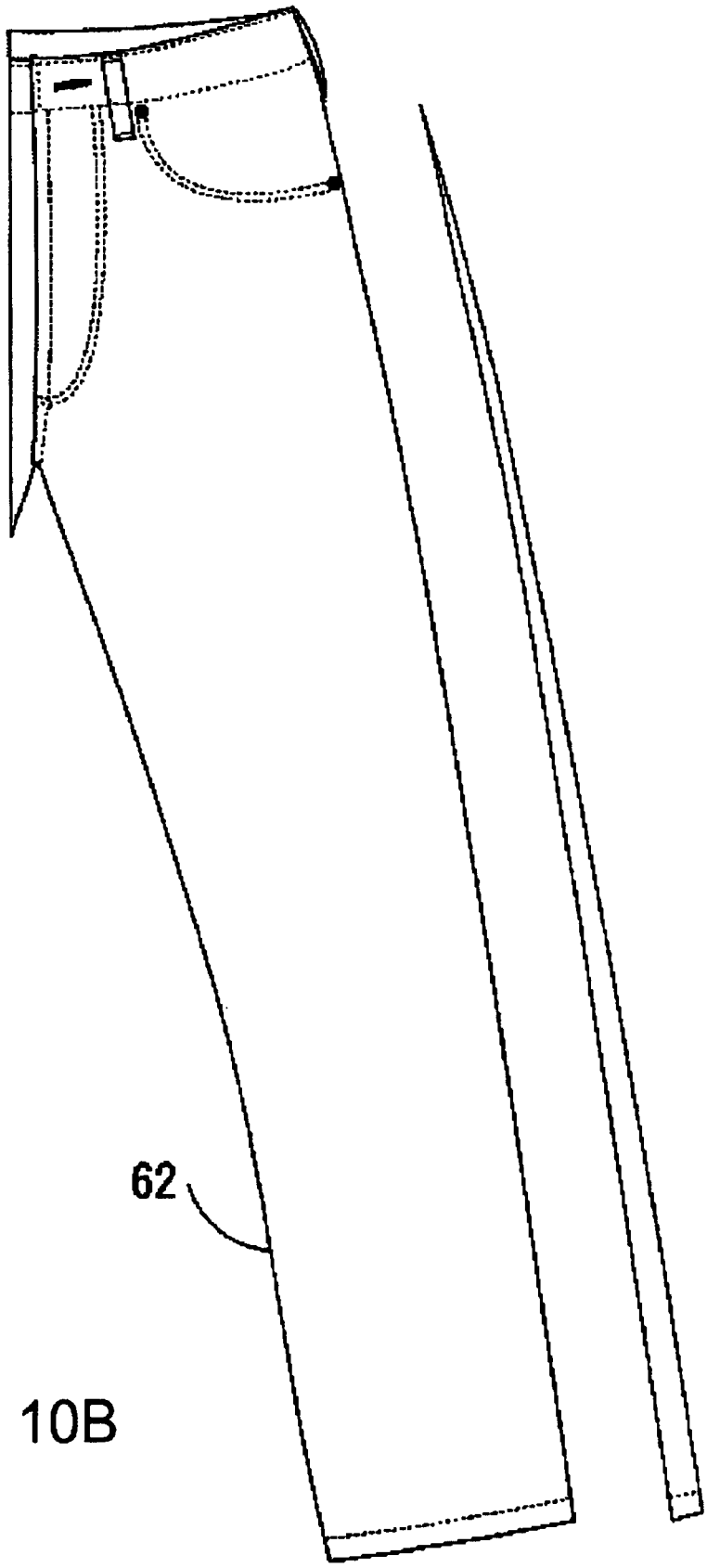

As just discussed in relation to FIG. 9, if the final garment does not have darts (step 910), then the in-tact item is maneuvered into the holder 12 in a flattened position so that the garment will appear in two dimensions for imaging as depicted in FIG. 10A. After obtaining the garment image 54 (step 930), the software program 24 can automatically or manually find the seams in the garment to separate and connect the scanned image into original pattern pieces (step 940). A scanned image 62 is shown in FIG. 10B, according to one embodiment (the sliver of fabric on the right side is part of the left front leg piece that has been virtually cut out due to seam recognition. It will be connected to the left back leg piece to form the original left back leg pattern, as will be described below). The remainder of this embodiment is in relation to FIG. 9 as described above.

Figure 11A:
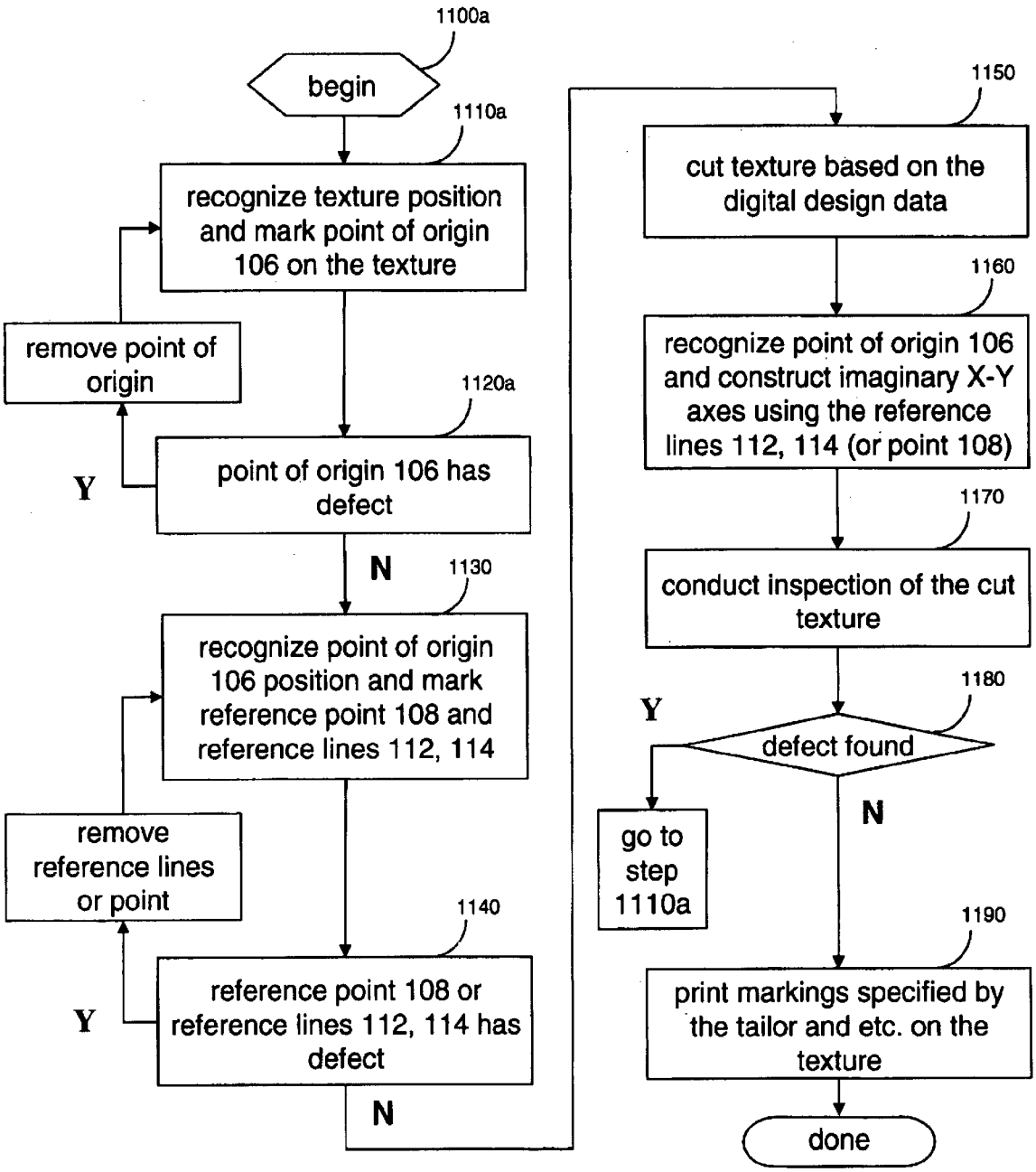
FIGS. 11A and 11B are flow diagrams illustrating operation of one example of the custom-made garment facility of FIG. 1 when pattern pieces are cut out and inspected by the X-Y coordinate data according to an embodiment of the present invention.
Figure 11B:
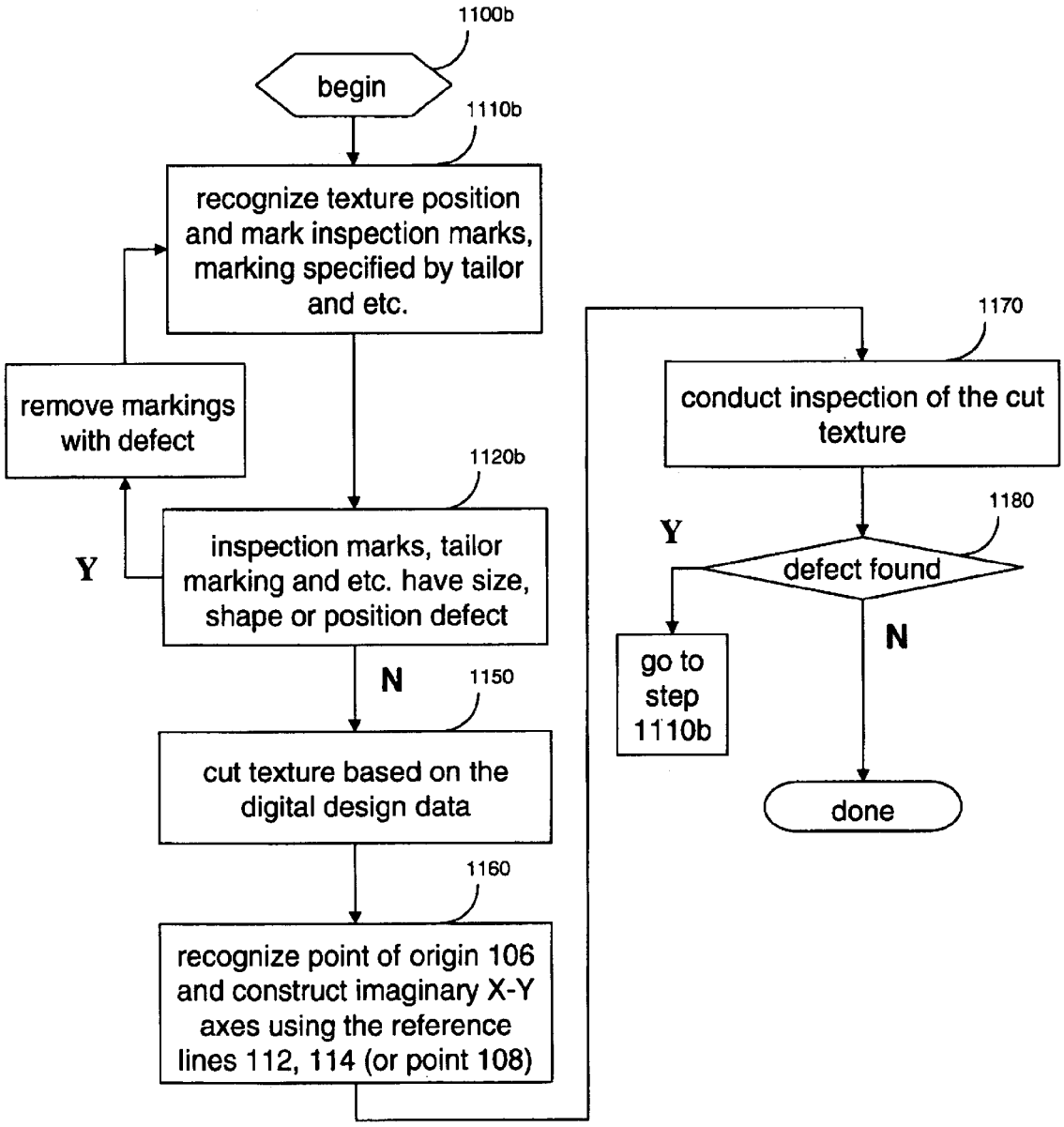

FIGS. 11A and 11B illustrate flow diagrams that describe an example operation of the process by which the digital design data, preserved within customer data 20, is used for marking, cutting and inspecting pattern pieces to be sewn together to form the custom-made garment 300. In FIG. 11A, inspection marks are marked by sewing a point of origin 106, reference point 108 and reference lines 112, 114 on the texture, while in FIG. 11B, inspection marks are marked by printing. In either embodiment of the marking and cutting process, an automated cut and sew machine, similar to the Tajima TLFD 904 product from Tajima Industries Ltd. (as shown on their website http://www.tajima.com), can be used. For printing, the sewing mechanism can be replaced with a printing mechanism, such as an ink jet printer head. Further, to facilitate continual inspection and verification during the marking and cutting process, the automated cut and sew machine can additionally have a recognition camera and be connected to the computer system 22 of the present invention. Alternatively, in another embodiment, the marking, cutting and inspection process can be conducted by different machines. One for marking the texture, one for cutting the texture, and one for inspecting the pattern pieces and final garments. Those of ordinary skill in the art recognize that a number of methods for making the inspection marks are available, and that reference to the automated cut and sew machine in the description represents but one of many possibilities for practicing the invention.

As shown in FIG. 11A, the marking and cutting process begins by recognizing the position (i.e., warp/weft thread direction, placement position, placement angle, etc.) of the texture within the cut and sew machine by recognition camera, and sewing the point of origin 106 onto the texture (step 1110*a*). The sewn point of origin 106 is then checked for defects (step 1120*a*) and re-sewn if necessary. Once the point of origin 106 is correct, reference point 108 and reference lines 112, 114 are sewn onto the texture in relation to the point of origin 106 and the texture's position (step 1130). The reference point 108 and reference lines 112, 114 are then checked for defects (step 1140) and re-sewn if necessary. When the point of origin 106, reference point 108 and reference lines 112, 114 are all accurate, the cut and sew machine can then cut the texture based on the digital design data (step 1150). After the pattern piece (or pieces) is cut, the machine can use the previously sewn point of origin 106, and reference lines 112, 114 (or reference point 108) to construct the imaginary X-Y axes on the pattern piece (step 1160). Using the imaginary X-Y axes, the system can now inspect the cut pattern piece with the original digital design data to ensure it's design is within pre-defined tolerances specified by the facility employee using computer system 22 (step 1170). If the pre-defined tolerances are not met, then the process begins again at the beginning (step 1180). If the pre-defined tolerances are met, then tailor-specified markings (e.g., easing amount, etc.), sample garment identifier (SID) and customer identifier (CID) are marked on the cut pattern piece (step 1190) and the piece is ready for final assembly. The SID and CID marked on the pattern piece will be used to keep track of the pattern pieces, and to identify the delivery information, and so on. During this process, some recognition steps to check for defects and alignment can be skipped and conducted together with other recognition steps to reduce the recognition time. On the other hand, recognition steps can be added to increase accuracy for cutting and marking the texture. The benefit of sewing, over printing the inspection marks, is that the sewn marks will survive washing or ironing the completed custom-made garment, more easily allowing for further inspection of the completed garment.

In FIG. 11B, the marking and cutting process begins by recognizing the texture position within the cut and sew machine and printing the inspection marks (point of origin 106, reference point 108, reference lines 112, 114), tailor specified markings, sample garment identifier (SID), and customer identifier (CID) onto the texture (step 1110*b*). All of the printed markings are then checked for defects (step 1120*b*) and re-printed if necessary. In one embodiment, disappearing medium, similar to disappearing Chako, (available from Adger Kogyo Co. Ltd. of Japan), that remains on the base pattern for only a limited duration can be used to print the inspection marks. Once the printed markings are all accurate, the cut and sew machine can then cut the texture based on the digital design data (step 1150). After the pattern piece (or pieces) is cut, the machine can use the previously printed point of origin 106 and reference lines 112, 114 (or reference point 108) to construct the imaginary X-Y axes on the pattern piece (step 1160). Using the imaginary X-Y axes, the system can now inspect the cut pattern piece to ensure it is within pre-defined tolerances (step 1170). If the pre-defined tolerances are not met, then the process begins again at the beginning. If the pre-defined tolerances are met, the piece is ready for final assembly (step 1180). The benefit of printing over sewing the markings is that the printing can be accomplished in a faster, one-pass, manner.

As depicted in FIGS. 8A–B, inspection marks (e.g., point of origin 106, reference point 108, reference lines 112, 114, etc.) marked by both sewing and/or printing method can also differ in colors or shape to be manually distinguished from each other by persons associated with the custom-made facility 100, or to be distinguished automatically by computer program 24. Once all of the individual pieces are cut as per one of the processes discussed in relation to FIGS. 11A–B, the pieces can be connected together to form the final garment 300. Once the final garment is connected together, it can be further inspected to ensure accuracy using the final inspection process depicted in FIGS. 12A–B. The final inspection process is basically the same as X-Y coordinate data creation process of FIG. 9 when scanning a customer's "favorite" garment.

Figure 12A:
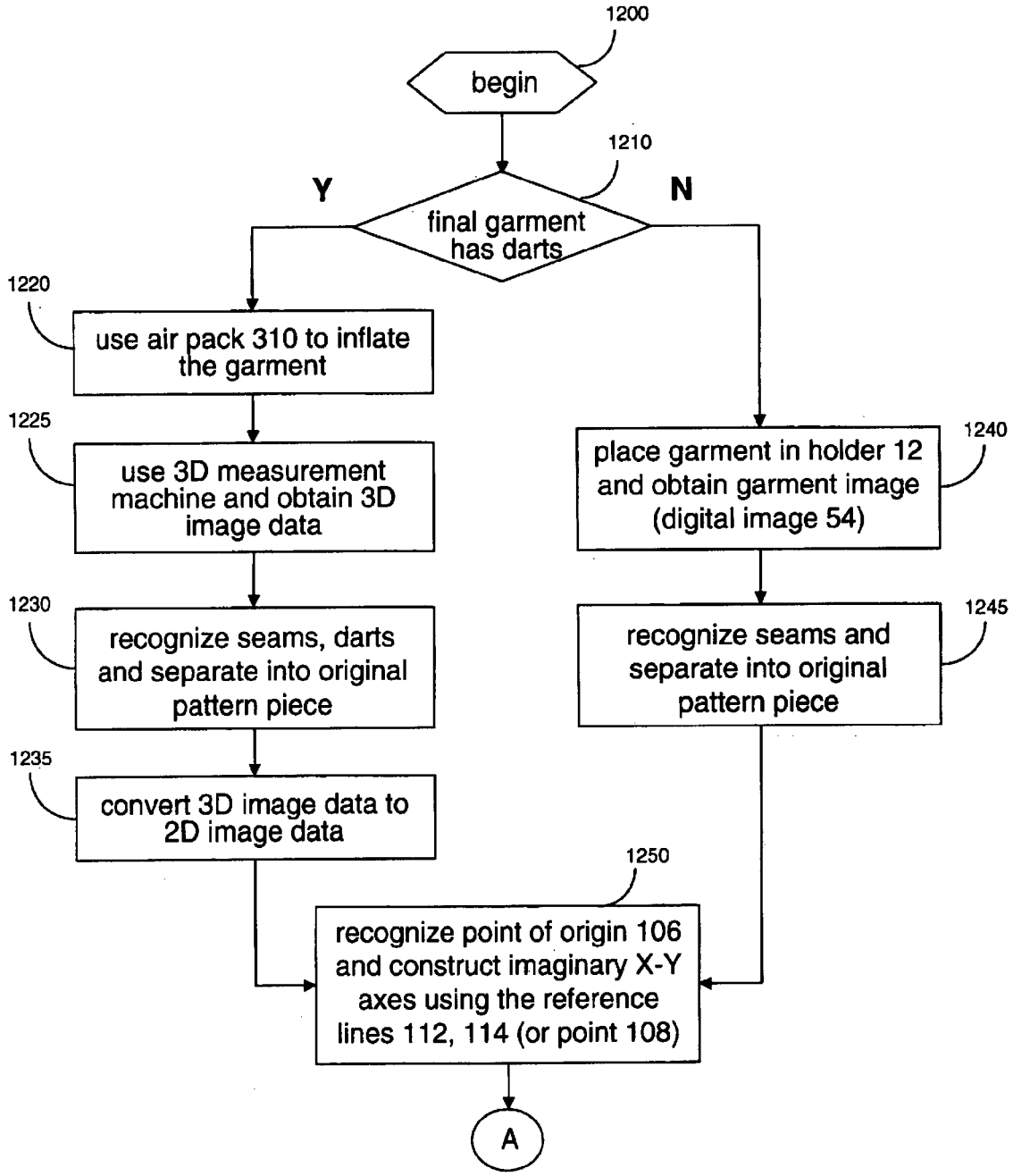
FIGS. 12A and 12B are flow diagrams illustrating operation of one example of the custom-made garment facility of FIG. 1 when inspecting a final garment according to an embodiment of the present invention.
Figure 13:
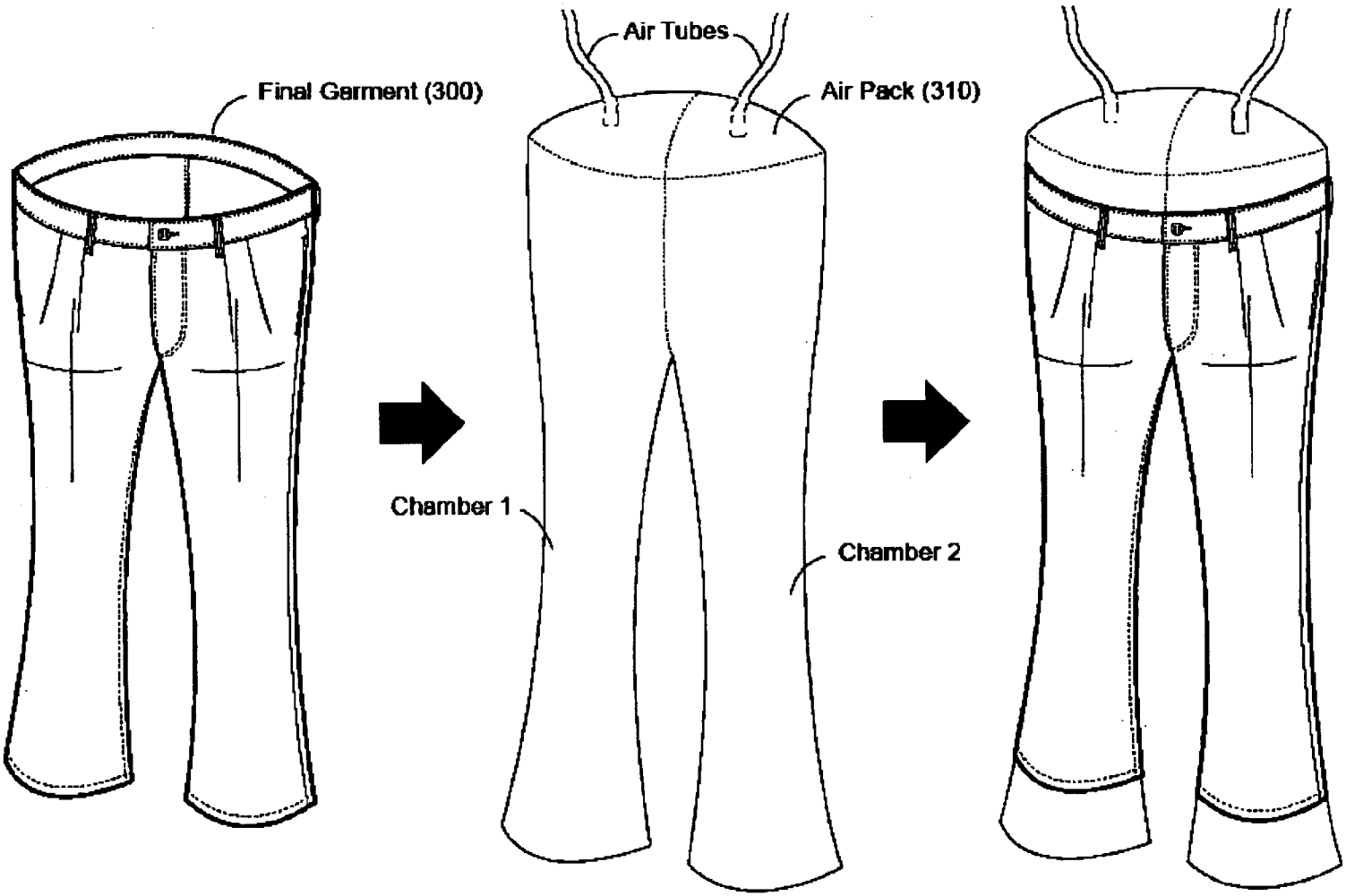
FIG. 13 is a schematic diagram illustrating how the garment with darts is brought to a designed style according to an embodiment of the present invention.
Figure 14:
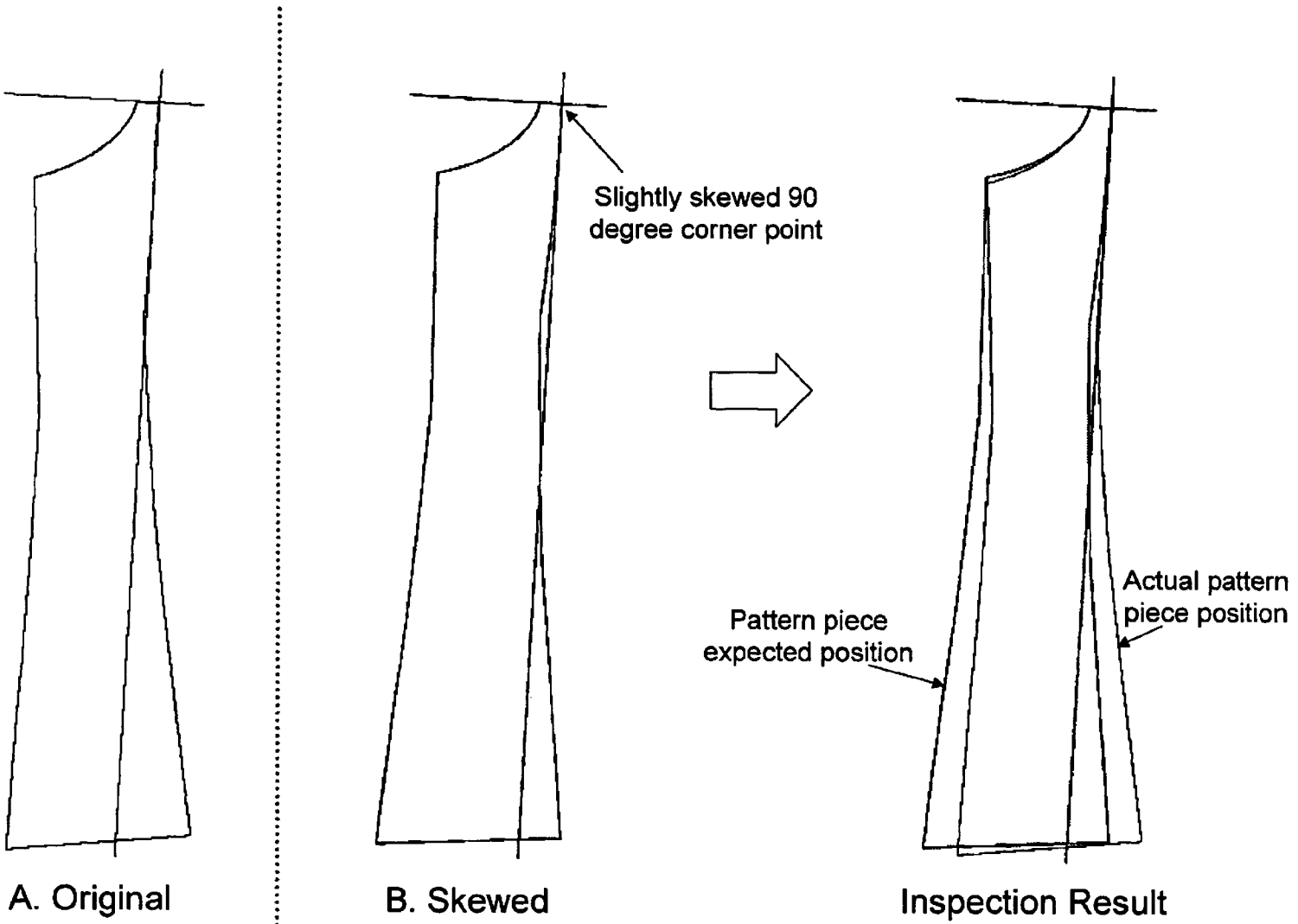
FIG. 14 illustrates an errant inspection resulting from a 90 degree corner on the pattern piece being slightly skewed from the intended position.

As shown in FIG. 12A, if the final garment 300 has darts, then the final garment can be inflated with stretchable air pack 310 as illustrated in FIG. 13 (step 1220) to obtain three-dimensional (3D) image data. A 3D measurement machine, similar to the Whole Body Color 3D Scanner Bundle product from Cyberware Laboratory, Inc. (as shown on their website http://www.cyberware.com), can be used to obtain 3D digital image of the inflated garment (step 1225). Once final garment digital image data 54 are obtained, seams and darts in the garment can be recognized by software 24 and the garment can be separated into each pattern piece using the "favorite" garment procedure as depicted in FIG. 9 (step 1230). Subsequently, the 3D image data can be converted into two-dimensional (2D) for further processing (step 1235). The software 24 will then recognize the existing point of origin 106, reference lines 112, 114 (or reference point 108) and construct the imaginary X-Y axes and grid over each pattern piece (step 1250).

As just discussed in relation to FIG. 12A, if the final garment 300 does not have darts (step 1210), it can be placed in the holder 12 for imaging (step 1240) as discussed and illustrated in relation to FIG. 10A, above. Once the final garment digital image data 54 are obtained, seams in the garment can be recognized by software 24 and the garment can be separated into each pattern piece using the "favorite" garment procedure as depicted in FIG. 9 and FIG. 10B (step 1245). The remainder of this embodiment is in relation to FIG. 12A as described above.

Figure 12B:
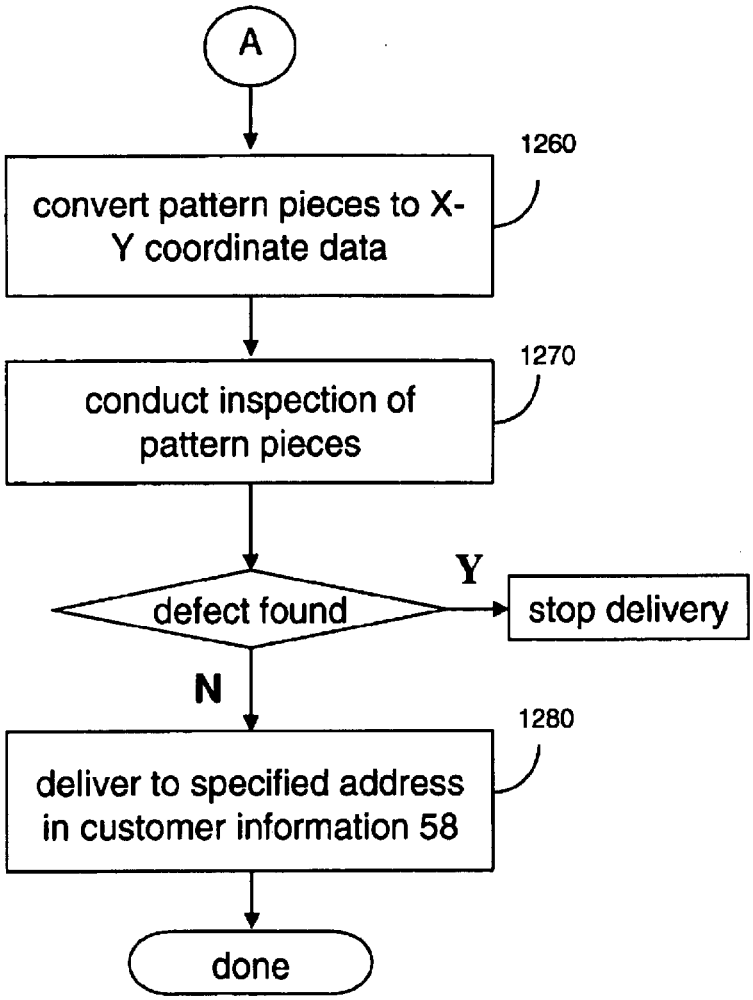

Now referring to FIG. 12B, the software 24 will convert each pattern piece into X-Y coordinate data using the imaginary X-Y axes (step 1260). Next, the obtained X-Y coordinate data is inspected to ensure the design is within pre-defined tolerances (step 1270). These tolerances can be entered into the system by the facility employee, but originally defined by any individual associated with the process. If a defect is found in the final garment 300, then the final garment is not shipped. Otherwise the final garment is delivered to the customer (step 1280).

As explained above, in order to obtain three-dimensional (3D) image data of final garment 300 during final inspection, stretchable air pack 310 can be used to style the garment as depicted in FIG. 13. Such may be the preferred method when the garment has darts, for example. The stretchable air pack can be made from material like polyester or stretchable texture that can maintain certain air pressure within the texture, and depending on air pack design, it can be separated into multiple chambers, each connected with an air tube, to give the required air-pressure to the intended position to bring the garment to its designed style.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

What is claimed is:

1. A system for producing a custom-made garment using specification data for a customer, comprising:

a base pattern capable of accepting inspection marks and mark lines, the mark lines being in accordance with design and fit preferences of the customer and further indicating how the base pattern is connected with other base patterns, the base pattern further capable of being connected to the other base patterns to comprise a style of a type of the custom-made garment;

a scanning system for producing an image of the marked base pattern; and a computer system that receives the image of the marked base pattern from the scanning system and determines the locations of the inspection marks and the mark lines therefrom.

2. The system according to claim 1, wherein the computer system is adapted to:

generate image data received from the scanning system in a specified file format.

3. The system according to claim 2, wherein the computer system is further adapted to associate the image data with the customer.

4. The system according to claim 3, wherein the computer system is further adapted to store the image data in a database.

5. The system according to claim 1, wherein the inspection marks include a point of origin and at least one of a reference point and reference lines associated with the base pattern.

6. The system according to claim 1, wherein the inspection marks and the mark lines are made using at least one of a non-erasable medium and a non-removable thread.

7. The system according to claim 1, wherein the inspection marks and the mark lines are made using a highly visible medium.

8. The system according to claim 7, wherein the highly visible medium is one of a Pen, chalk and ink that is naturally disappearing or erasable.

9. The system according to claim 8, wherein the Pen, the chalk and the ink are each any color.

10. A system according to claim 1, wherein the base pattern comprises a piece of a sample garment associated with the custom-made garment.

11. The system according to claim 1, wherein the computer system is adapted to generate the specification data from the image, the specification data representing a design of the base pattern as adjusted by the mark lines and in relation to a distance from the inspection marks.

12. The system according to claim 11 , wherein the specification data further represents tailor parameters, wherein the tailor parameters are manually entered into the computer system.

13. The system according to claim 11, wherein the specification data utilize a three-dimensional coordinate system.

14. The system according to claim 11, wherein the inspection marks include a point of origin and at least one of a reference point and reference lines, all associated with the base pattern.

15. The system according to claim 14, wherein generating the specification data includes creating X-Y coordinate data of the mark lines using the inspection mark to construct imaginary X-Y axes and associated imaginary X-Y grid.

16. The system according to claim 11, wherein the computer system stores the generated specification data in a database.

17. The system according to claim 16, wherein the database further stores information about the customer, and associates the specification data with the customer.

18. The system according to claim 17, wherein the information about the customer includes at least one of a customer ID, a try-on garment ID, a base-pattern ID, and a sample garment ID.

19. The system according to claim 11, further comprising a cutting system adapted to receive the specification data, cut fabric using the specification data of the adjusted base pattern, and inspect the cut fabric using the specification data.

20. The system according to claim 19, wherein the cutting system is further adapted to inspect the cut fabric using at least one of the design of the base pattern, the image of the marked base pattern, and the locations of the inspection marks and the mark lines.

21. The system according to claim 19, wherein the cutting system includes an automated cut and sew machine.

22. The system according to claim 21, wherein the automated cut and sew machine includes a recognition camera and an optional ink jet head attachment.

23. The system according to claim 22, wherein the automated cut and sew machine recognizes a warp/weft thread direction and a placement position of fabric placed there within using the recognition camera.

24. The system according to claim 19, wherein the cutting system is further adapted to, prior to cutting the fabric, mark the fabric using the specification data and verify the accuracy of the marked fabric using the placement and location of the inspection marks.

25. The system according to claim 24, wherein the cutting system is further adapted to determine a position and an angle of the inspection marks relative to the specification data using a calculated position of the fabric within the cutting system.

26. The system according to claim 16, further comprising a cutting system adapted to receive the X-Y coordinate data, cut fabric according to the received X-Y coordinate data, and inspect the cut fabric using the inspection marks to re-construct imaginary X-Y axes and associated imaginary X-Y grid over the cut fabric.

27. The system according to claim 26, wherein the cutting system includes an automated cut and sew machine.

28. The system according to claim 27, wherein the automated cut and sew machine includes a recognition camera and an optional inkjet head attachment.

29. The system according to claim 26, wherein the cutting system is further adapted to, prior to cutting the fabric, mark the fabric using the X-Y coordinate data and verify the accuracy of the marked fabric using the inspection mark to re-construct imaginary X-Y axes and associated imaginary X-Y grid over the marked fabric.

30. The system according to claim 19, farther comprising a sewing system adapted to sew together the cut fabric to produce the custom-made garment.

31. The system according to claim 30, wherein the sewing system is also adapted to inspect the custom-made garment using the placement and location of the inspection marks.

32. The system according to claim 29, further comprising a sewing system adapted to sew together the cut fabric to produce the custom-made garment.

33. The system according to claim 32, wherein the sewing system includes an inspection system.

34. The system according to claim 33, wherein the inspection system is adapted to inspect the custom-made garment using the inspection marks to re-construct imaginary X-Y axes and associated imaginary X-Y grid over the cut fabric.

35. The system according to claim 33, wherein the inspection system is adapted to:

scan at least one of an image of the custom-made garment in three-dimensions and three-dimensional coordinate data for the custom-made garment; and inspect the custom-made garment using at least one of the scanned three-dimensional image and the three-dimensional coordinate data.

36. The system according to claim 35, wherein the inspection system uses an air pack system to scan the custom-made garment and to inspect the custom-made garment.

37. The system according to claim 33, wherein the inspection system is adapted to inspect the custom-made garment using the image of the marked base pattern.

38. The system according to claim 1, wherein the scanning system includes a transparent holder for holding the base pattern during scanning.

39. The system according to claim 1, wherein the computer system includes a monitor for displaying the scanned image.

40. The system according to claim 39, wherein the monitor further displays one or more of a try-on garment identifier, a base pattern identifier, a sample garment identifiers and a customer identifier.

41. The system according to claim 19, wherein the computer system includes software for controlling the scanning system and the cutting system.

42. The system according to claim 26, wherein the computer system includes software for controlling the scanning system and the cutting system.

43. The system according to claim 1, wherein the scanning system is located remotely from the computer system.

44. The system according to claim 19, wherein the cutting system is located remotely from the computer system.

45. The system according to claim 26, wherein the cutting system is located remotely from the computer system.

46. The system according to claim 1, wherein the computer system is adapted to generate the specification data from a combination of the image and manually input inspection tolerance data, the specification data representing a design of the base pattern as adjusted by tailor markings and the mark lines and in relation to a distance from the inspection marks.

47. The system according to claim 46, wherein the design of the base pattern further includes specified seam positions in relation to the inspection marks.

48. The system according to claim 46, wherein the inspection marks include a point of origin and at least one of a reference point and reference lines, all associated with the base pattern.

49. The system according to claim 46, wherein the computer system stores the generated specification data in a database.

50. The system according to claim 47, further comprising a cutting system adapted to receive the specification data, cut fabric using the specification data of the adjusted base pattern, and inspect the cut fabric using the specification data.

51. The system according to claim 50, wherein the cutting system is further adapted to inspect the cut fabric using at least one of the design of the base pattern, the image of the marked base pattern, and the locations of the inspection marks and the mark lines.

52. A system for creating specification data for use in creating a custom-made garment, the system comprising:

a marked base pattern containing inspection marks and mark lines, the lines being in accordance with preferences of the customer and further indicating how the base pattern is connected with other base patterns, the base pattern further capable of being connected to the other base patterns to comprise a style of a type of the custom-made garment;

a scanning system for producing an image of the marked base pattern; and a computer system that receives the image of the marked base pattern from the scanning system, wherein the computer system is adapted to generate specification data from the image, the specification data representing a design of the marked base pattern and placement and location of the inspection marks.

53. The system according to claim 52, wherein the inspection marks include a point of origin and at least one of a reference point and reference lines, all associated with the marked base pattern.

54. The system according to claim 52, wherein the inspection marks include a reference point to indicate an intended direction of coordinate X-Y axes.

55. A system for creating specification data for use in creating a custom-made garment, the system comprising:

a favorite garment of a customer, the favorite garment representing customer preferences;

a transparent holder for holding the favorite garment in a two-dimensional manner;

a scanning system for producing an image of the favorite garment; and a computer system that receives the image of the favorite garment from the scanning system, wherein the computer system is adapted to generate specification date from the image, the specification data representing a design of the favorite garment and placement and location of inspection marks.

56. A method for producing a custom-made garment using specification data for a customer, the method comprising the steps of:

providing a base pattern capable of accepting inspection marks and mark lines, the mark lines being in accordance with design and fit preferences of the customer and further indicating how the base pattern is connected with other base patterns, the base pattern further capable of being connected to the other base patterns to comprise a style of a type of the custom-made garment;

operating a scanning system for producing an image of the marked base pattern; and utilizing a computer system that receives the image of the marked base pattern from the scanning system and determines the locations of the inspection marks and the mark lines therefrom.

57. The method according to claim 56, wherein the computer system:

generates image data received from the scanning system in a specified file format.

58. The method according to claim 57, wherein the computer system further associates the image data with the customer.

59. The method according to claim 58, wherein the computer system further stores the image data in a database.

60. The method according to claim 56, wherein the inspection marks include a point of origin and at least one of a reference point and reference lines associated with the base pattern.

61. The method according to claim 56, wherein the inspection marks are made using at least one of a non-erasable medium and a non-removable thread.

62. The method according to claim 56, wherein the inspection marks and the mark lines are made using a highly visible medium.

63. The method according to claim 62, wherein the highly visible medium is one of a Pen, chalk and ink that is naturally disappearing or erasable.

64. The method according to claim 63, wherein the Pen, the chalk and the ink are each any color.

65. A system according to claim 56, wherein the base pattern comprises a piece of a sample garment associated with the custom-made garment.

66. The method according to claim 56, wherein the computer system generates the specification data from the image, the specification data representing a design of the base pattern as adjusted by tailor markings and the mark lines and in relation to a distance from the inspection marks.

67. The system according to claim 66, wherein the design of the base pattern further includes specified seam positions in relation to the inspection marks.

68. The method according to claim 66, wherein the specification data further represents tailor parameters, wherein the tailor parameters are manually entered into the computer system.

69. The method according to claim 66, wherein the specification data utilize a three-dimensional coordinate system.

70. The method according to claim 66, wherein the inspection marks include a point of origin and at least one of a reference point and reference lines, all associated with the base pattern.

71. The method according to claim 70, wherein generating the specification data includes creating X-Y coordinate data of the mark lines using the inspection mark to construct imaginary X-Y axes and associated imaginary X-Y grid.

72. The method according to claim 66, wherein the computer system stores the generated specification data in a database.

73. The method according to claim 72, wherein the database further stores information about the customer, and associates the specification data with the customer.

74. The method according to claim 73, wherein the information about the customer includes at least one of a customer identifier, a try-on garment identifier, a base-pattern identifier, and a sample garment identifier.

75. The method according to claim 66, further comprising the step of using a cutting system, the cutting system receives the specification data, cuts fabric using the specification data of the adjusted base pattern, and inspects the cut fabric using the specification data.

76. The method according to claim 75, wherein the cutting system inspects the cut fabric using at least one of the design of the base pattern, the image of the marked base pattern, and the locations of the inspection marks and the mark lines.

77. The method according to claim 75, wherein the cutting system includes an automated cut and sew machine.

78. The method according to claim 77, wherein the automated cut and sew machine includes a recognition camera and an optional ink jet head attachment.

79. The method according to claim 78, wherein the automated cut and sew machine recognizes a warp/weft thread direction and a placement position of fabric placed there within using the recognition camera.

80. The method according to claim 75, wherein the cutting system is further adapted to, prior to cutting the fabric, mark the fabric using the specification data and verify the accuracy of the marked fabric using the placement and location of the inspection marks.

81. The method according to claim 80, wherein the cutting system is further adapted to determine a position and an angle of the inspection marks relative to the specification data using a calculated position of the fabric within the cutting system.

82. The method according to claim 72, further comprising the step of using a cutting system, the cutting system adapted to receive the X-Y coordinate data, cut fabric according to the received X-Y coordinate data, and inspect the cut fabric using the inspection mark to re-construct imaginary X-Y axes and associated imaginary X-Y grid over the cut fabric.

83. The method according to claim 82, wherein the cutting system includes an automated cut and sew machine.

84. The method according to claim 83, wherein the automated cut and sew machine includes a recognition camera and an optional inkjet head attachment.

85. The method according to claim 82, wherein the cutting system is further adapted to, prior to cutting the fabric, mark the fabric using the X-Y coordinate data and verify the accuracy of the marked fabric using the inspection mark to re-construct imaginary X-Y axes and associated imaginary X-Y grid over the marked fabric.

86. The method according to claim 75, further comprising the step of using a sewing system, the sewing system adapted to sew together the cut fabric to produce the custom-made garment.

87. The method according to claim 86, wherein the sewing system also inspects the custom-made garment using the placement and location of the inspection marks.

88. The method according to claim 85, further comprising the step of using a sewing system adapted to sew together the cut fabric to produce the custom-made garment.

89. The method according to claim 88, wherein the sewing system includes an inspection system.

90. The method according to claim 89, wherein the inspection system inspects the custom-made garment using the inspection mark to re-construct imaginary X-Y axes and associates imaginary X-Y grid over the cut fabric.

91. The method according to claim 90, wherein the inspection system uses an air pack system to scan the three-dimensional image of the custom-made garment.

92. The method according to claim 89, wherein the inspection system:

scans at least one of an image of the custom-made garment in three-dimensions and three-dimensional coordinate data for the custom-made garment; and inspects the custom-made garment using at least one of the scanned three-dimensional image and the three-dimensional coordinate data.

93. The method according to claim 92, wherein the inspection system scans the custom-made garment and inspects the custom-made garment using an air pack system.

94. The method according to claim 89, wherein the inspection system inspects the custom-made garment using the image of the marked base pattern.

95. The method according to claim 56, wherein the scanning system includes a transparent holder for holding the base pattern during scanning.

96. The method according to claim 56, wherein the computer system includes a monitor for displaying the scanned image.

97. The method according to claim 96, wherein the monitor further displays one or more of a try-on garment identifier, a base pattern identifier, a sample garment identifiers and a customer identifier.

98. The method according to claim 75, wherein the computer system includes software for controlling the scanning system and the cutting system.

99. The method according to claim 82, wherein the computer system includes software for controlling the scanning system and the cutting system.

100. The method according to claim 56, wherein the scanning system is located remotely from the computer system.

101. The method according to claim 75, wherein the cutting system is located remotely from the computer system.

102. The method according to claim 82, wherein the cutting system is located remotely from the computer system.

103. The method according to claim 56, wherein the computer system is adapted to generate the specification data from a combination of the image and manually input inspection tolerance data, the specification data representing a design of the base pattern as adjusted by tailor markings and the mark lines and in relation to a distance from the inspection marks.

104. The method according to claim 103, wherein the design of the base pattern further includes specified seam positions in relation to the inspection marks.

105. The method according to claim 103, wherein the inspection marks include a point of origin and at least one of a reference point and reference lines, all associated with the base pattern.

106. The method according to claim 103, wherein the computer system stores the generated specification data in a database.

107. The method according to claim 104, further comprising the step of using a cutting system, the cutting system receives the specification data, cuts fabric using the specification data of the adjusted base pattern, and inspects the cut fabric using the specification data.

108. The method according to claim 107, wherein the cutting system inspects the cut fabric using at least one of the design of the base pattern, the image of the marked base pattern, and the locations of the inspection marks and the mark lines.

109. A method for creating specification data for use in creating a custom-made garment, the method comprising the steps of:

marking a base pattern to contain inspection marks and mark lines, the mark lines being in accordance with preferences of the customer and further indicating how the base pattern is connected with other base patterns, the base pattern further capable of being connected to the other base patterns to comprise a style of a type of the custom-made garment;

producing an image of the marked base pattern using a scanning system; and receiving the image of the marked base pattern from the scanning system with a computer system, wherein the computer system is adapted to generate specification data from the image, the specification data representing a design of the marked base pattern and placement and location of the inspection marks.

110. The method according to claim 109, wherein the inspection marks include a point of origin and at least one of a reference point and reference lines, all associated with the marked base pattern.

111. The method according to claim 109, wherein the inspection marks include a reference point to indicate an intended direction of coordinate X-Y axes.

112. A method for creating specification data for use in creating a custom-made garment, the method comprising the steps of:

providing a favorite garment of a customer, the favorite garment representing customer preferences;

providing a transparent holder for holding the favorite garment in a two-dimensional manner;

producing an image of the favorite garment using a scanning system; and receiving the image of the favorite garment from the scanning system with a computer system, wherein the computer system is adapted to generate specification data from the image, the specification data representing a design of the favorite garment and placement and location of inspection marks.

* * * * *